US011193744B2

(12) United States Patent
Aminov et al.

(10) Patent No.: US 11,193,744 B2
(45) Date of Patent: Dec. 7, 2021

(54) SAFETY DEVICE

(71) Applicant: ISRAEL AEROSPACE INDUSTRIES LTD., Lod (IL)

(72) Inventors: Gavriel Aminov, Elad (IL); Eyal Zehavi, Gedera (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 175 days.

(21) Appl. No.: 16/471,829

(22) PCT Filed: Jan. 7, 2018

(86) PCT No.: PCT/IL2018/050020
§ 371 (c)(1),
(2) Date: Jun. 20, 2019

(87) PCT Pub. No.: WO2018/127922
PCT Pub. Date: Jul. 12, 2018

(65) Prior Publication Data

US 2020/0096303 A1 Mar. 26, 2020

(30) Foreign Application Priority Data

Jan. 8, 2017 (IL) ..... 249976

(51) Int. Cl.
*F42C 15/184* (2006.01)
*F42C 15/34* (2006.01)

(52) U.S. Cl.
CPC ..... *F42C 15/184* (2013.01); *F42C 15/34* (2013.01)

(58) Field of Classification Search
CPC ..... F42C 15/184; F42C 15/34
See application file for complete search history.

(56) References Cited

U.S. PATENT DOCUMENTS 780,366 A 1/1905 Metten
3,823,670 A * 7/1974 Zacharin ..... F42C 14/02 102/487

(Continued)

FOREIGN PATENT DOCUMENTS

DE 102012021449 A1 4/2014
WO 2016207250 A1 12/2016

OTHER PUBLICATIONS

International Search Report and Written Opinion from International Application No. PCT/IL2018/050020 dated Apr. 8, 2018.

(Continued)

*Primary Examiner* — Michelle Clement
(74) *Attorney, Agent, or Firm* — Dorsey & Whitney LLP

(57) ABSTRACT

Examples of safety devices for use with a munition are provided, the munition including a munition explosive and a safe and arm (S&A) device for activation of the munition explosive. In some examples the safety device includes a switch member and an actuation mechanism. The switch member is configured for being disposed between the munition explosive and the S&A device, the switch member being movable between at least two switch positions. In a first switch position (an arming prevention position (APP)), arming communication between the munition explosive and the S&A device is prevented. In a second switch position (an arming enabling position (AEP)), arming communication between the munition explosive and the S&A device is allowed. The actuation mechanism is configured for selectively moving the switch member at least from the APP to the AEP to thereby enable the S&A device, when armed, to detonate the munition explosive via the switch member.

20 Claims, 17 Drawing Sheets

(56) References Cited

U.S. PATENT DOCUMENTS 3,851,531 A 12/1974 White et al.
3,958,511 A * 5/1976 Morrow ..... F42C 15/24 102/251
4,090,450 A * 5/1978 Nygards ..... F42C 15/34 102/244
4,286,521 A * 9/1981 Marer ..... F42B 3/18 102/200
4,660,472 A * 4/1987 Stevens ..... F42C 15/34 102/202.1
4,667,600 A 5/1987 Jensen et al.
4,712,478 A * 12/1987 Haglund ..... F42C 15/34 102/401
4,986,184 A * 1/1991 Kude ..... F42C 15/184 102/244
5,074,217 A 12/1991 Gabriels
6,272,995 B1 8/2001 Schmidt et al.
6,295,932 B1 10/2001 Kane
6,530,324 B1 * 3/2003 Steele ..... F42C 15/184 102/229
7,051,656 B1 * 5/2006 Koehler ..... F42C 15/005 102/222
8,661,979 B2 * 3/2014 Veksler ..... F42C 14/02 102/256
8,820,241 B2 9/2014 Kautzsch et al.
2003/0037691 A1 * 2/2003 Steele ..... F42C 15/184 102/254
2003/0070571 A1 4/2003 Hodge et al.
2004/0144279 A1 7/2004 Glatthaar et al.
2007/0131127 A1 * 6/2007 Magnan ..... F42C 15/184 102/222
2008/0072781 A1 3/2008 Sigler et al.
2008/0134922 A1 * 6/2008 Grattan ..... E21B 43/1185 102/206
2012/0145029 A1 * 6/2012 Veksler ..... F42C 15/34 102/481
2012/0266771 A1 * 10/2012 Renaud-Bezot ..... F42C 15/24 102/235
2020/0096303 A1 * 3/2020 Aminov ..... F42C 15/34

OTHER PUBLICATIONS

Fowler, "Safety and Arming Device Design Principles", Naval Air Warfare Center Weapons Division China Lake, CA, 93555-6100, May 1999, 30 pages.

* cited by examiner

SAFETY DEVICE

TECHNOLOGICAL FIELD

The presently disclosed subject matter relates to munitions, in particular to arming systems for explosives.

BACKGROUND ART

References considered to be relevant as background to the presently disclosed subject matter are listed below:

U.S. Pat. No. 780,366

U.S. Pat. No. 4,667,600

U.S. Pat. No. 6,295,932

SAFETY AND ARMING DEVICE DESIGN PRINCIPLES, Steven E Fowler, Naval Air Warfare Center Weapons Division China Lake, Calif. 93555-6100; May 1999.

Acknowledgement of the above references herein is not to be inferred as meaning that these are in any way relevant to the patentability of the presently disclosed subject matter.

BACKGROUND

Safety and arming (S&A) devices are well known in the art of munitions, in particular relating to warheads in missiles as well as in bombs and other free-fall weapons.

Conventionally, S&A devices have a number of functions, including at least the following:

- keeping the ordnance (explosive) section of a munition from arming during shipping, handling or storage;
- arming the ordnance section when a predetermined set of conditions is met (typically via sensors);
- causing high explosives in the ordnance section to detonate when hitting the target or at predetermined distance therefrom.

Conventionally, S&A devices are configured as self-contained components, and provide isolation of the relatively insensitive secondary explosives from external stimuli that could otherwise transfer enough energy to initiate the explosives. Such stimuli can include, for example, heat, shock, light, or static electricity. Such isolation can be provided by a mechanical barrier between the detonator and the high explosives when the S&A device is in the safe mode, and the mechanical barrier and the detonator are an integral part of the S&A device. The mechanical barrier operates to block transmission of any explosive shock from the detonator to the high explosives that may occur in response to any such stimuli. In the armed mode, the mechanical barrier is removed, and is replaced with a transfer lead that allows energy from the detonator to flow to the high explosive and detonate the same, typically either in response to the target being approached or hit (the desired result) or in response to unwanted stimuli (undesired result).

Conventionally, S&A devices are configured with an arming delay feature, to provide a delay (usually corresponding to an elapsed time or a distance travelled by the munition) between deployment of the munition and arming thereof. This serves to provide a safety zone around the point of deployment, or defines an evacuation time period, to minimize risk of the exploding munition becoming a hazard to personal or equipment at the point of deployment.

There are cases in which a single point failure may occur, in which for example the S&A device may be caused to arm prematurely, thereby becoming a safety hazard.

Conventionally, once a munition is deployed and it is subsequently decided to abort (but prior to the signal to arm the S&A device having been sent to the munition), the munition is rarely if ever recovered. This abandonment of the munition is carried out as a safety measure since conventionally it cannot be known for certain that the S&A device did not become accidentally armed, for example as a result of single point failure, and thus could now be a hazard. On the other hand, this safety measure is costly, as in the vast majority of cases the S&A device is in fact not armed, and the munition could have been safely recovered for future use and has been discarded instead.

GENERAL DESCRIPTION

According to a first aspect of the presently disclosed subject matter there is disclosed a safety device for use with a munition, the munition including a munition explosive and a safe and arm (S&A) device for activation of the munition explosive, the safety device (being different from the S&A device and). In at least a first example the safety device comprises:

- a switch member, configured for being disposed between the munition explosive and the S&A device, said switch member being movable between at least two switch positions including:
  - a first switch position, being an arming prevention position (APP), in which arming communication between the munition explosive and the S&A device is prevented [i.e., blocked]; and
  - a second switch position, being an arming enabling position (AEP), in which arming communication between the munition explosive and the S&A device is allowed (i.e., open communication is provided);
- an actuation mechanism for selectively moving said switch member at least from said APP to said AEP to thereby enable the S&A device, when armed, to detonate the munition explosive via the switch member.

For example, said switch member comprises a marker element, wherein the marker element is configured for providing an externally observable indication corresponding to the switch member being in at least one of said switch positions Additionally or alternatively, for example, the first example of the safety device can include one or more of the following features.

Additionally or alternatively, for example, said switch member comprises a transfer lead portion, configured to be in arming contact with, and thereby providing arming communication between, the munition explosive and the S&A device when said switch member is at said AEP.

Additionally or alternatively, for example, said switch member comprises a blocking portion, configured to block arming contact with, and thereby prevent arming communication between, the munition explosive and the S&A device when said switch member is at said APP.

Additionally or alternatively, for example, said switch member is moved from said APP to said AEP in linear motion along an activation axis. Additionally or alternatively, for example, wherein said switch member is in the form of a elongate rod having a rod longitudinal axis, wherein said transfer lead portion is longitudinally spaced from said blocking portion along said rod longitudinal axis. For example, said rod longitudinal axis is parallel to said activation axis.

Additionally or alternatively, for example, said switch member is moved from said APP to said AEP in pivoting motion about a pivot axis. Additionally or alternatively, for example, said switch member is in the form of a plate having a plate pivoting axis, wherein said transfer lead portion is circumferentially spaced from said blocking portion with respect to said plate pivoting axis. For example, said plate pivoting axis is coaxial with said pivot axis.

Additionally or alternatively, for example, the safety device is independent/different from the S&A device.

Additionally or alternatively, for example, the marker element is configured for providing an externally observable indication correspondingly relating to at least one of the following:

- that said switch member is at said APP concurrent with said switch member being at said APP;
- that said switch member is at said AEP concurrent with said switch member being at said AEP;
- that said switch member is at said APP concurrent with said switch member being at said APP; and that said switch member is at said AEP concurrent with said switch member being at said AEP.

For example, said marker element comprises a rod member that is deployable from a retracted position, in which the rod member is not externally observable, and a deployed position, in which the rod member is externally observable. For example, said switch member from said APP to said AEP in linear motion along an activation axis, and wherein said rod member is linearly deployable from said retracted position, in which the rod member is enclosed in a housing and thereby not externally observable, and a deployed position, in which the rod member projects outside of said housing and is thereby externally observable. Alternatively, for example, said switch member from said APP to said AEP in pivoting motion about a pivot axis, and wherein said rod member is pivotably deployable from said retracted position, in which the rod member is enclosed in a housing and thereby not externally observable, and a deployed position, in which the rod member pivots to a position outside of said housing and is thereby externally observable. Alternatively, for example, said switch member from said APP to said AEP in linear motion along an activation axis, and wherein said rod member is linearly deployable from said retracted position, in which the rod member is enclosed in a housing and thereby not externally observable, and a deployed position, in which the rod member projects outside of said housing and is thereby externally observable. Alternatively, for example, said switch member from said APP to said AEP in pivoting motion about a pivot axis, and wherein said rod member is pivotably deployable from said retracted position, in which the rod member is enclosed in a housing and thereby not externally observable, and a deployed position, in which the rod member pivots to a position outside of said housing and is thereby externally observable.

Additionally or alternatively, for example, said retracted position corresponds to said AEP. Alternatively, for example, said retracted position corresponds to said APP.

Additionally or alternatively, for example, said marker element comprises an electromagnetic wave transmitter configured for selectively operating in a transmitting mode or in a non-transmitting mode, wherein in said transmitting mode said electromagnetic wave transmitter selectively transmits electromagnetic waves within a first wavelength range, and wherein in said non-transmitting mode said electromagnetic wave transmitter does not transmit electromagnetic waves within said first wavelength range. For example, said transmitting mode corresponds to said AEP and wherein said non-transmitting mode corresponds to said APP; alternatively, for example, said transmitting mode corresponds to said APP and wherein said non-transmitting mode corresponds to said AEP. For example, the first wavelength range corresponds to one or more of the ultraviolet wavelength range, or the visible spectrum wavelength range, or to the infra-red wavelength range.

Additionally or alternatively, for example, said marker element comprises an electromagnetic wave transmitter configured for selectively operating in a first transmitting mode or in a second transmitting mode, wherein in said first transmitting mode said electromagnetic wave transmitter selectively transmits electromagnetic waves within a first wavelength range, and wherein in said second transmitting mode said electromagnetic wave transmitter transmits electromagnetic waves within a second first wavelength range different from said first wavelength range. For example, said first transmitting mode corresponds to said AEP and wherein said second transmitting mode corresponds to said APP; alternatively, for example, said first transmitting mode corresponds to said APP and wherein said second transmitting mode corresponds to said AEP. For example, the first wavelength range corresponds to one or more of the ultraviolet wavelength range, or the visible spectrum wavelength range, or to the infra-red wavelength range. Additionally or alternatively, for example, the second wavelength range corresponds to one or more of the ultraviolet wavelength range, or the visible spectrum wavelength range, or to the infra-red wavelength range. Additionally or alternatively, for example, the marker element is visually observable.

Additionally or alternatively, for example, said actuation mechanism is configured for selectively moving said switch member from said APP to said AEP, responsive to an actuation event. For example, said safety device is coupled to a communication module, and wherein said actuation event includes the communication module receiving an externally transmitted first attack signal. Additionally or alternatively, for example, said safety device is coupled to a timing module, and wherein said actuation event includes the timing module determining that a predetermined time period has elapsed from a start time. Additionally or alternatively, for example, said safety device is coupled to an altitude sensor module, and wherein said actuation event includes the altitude sensor module determining that a predetermined altitude has been reached. Additionally or alternatively, for example, said safety device is coupled to a navigation module, and wherein said actuation event includes the navigation module determining that a predetermined geographical position has been reached.

Additionally or alternatively, for example, said actuation mechanism comprises a linear actuator or a rotary actuator.

Additionally or alternatively, for example, the safety device comprises or is operatively connected to a Remove Before Operation (RBO) pin having an engaged configuration wherein the RBO pin mechanically prevents arming of the S&A device, and a disengaged configuration wherein the RBO pin cannot mechanically prevent arming of the S&A device. Alternatively, the safety device comprises or is operatively connected to a Remove Before Operation (RBO) pin having an engaged configuration wherein the RBO pin mechanically prevents arming of the S&A device and concurrently mechanically prevents movement of said switch member from said APP to said AEP, and a disengaged configuration wherein the RBO pin cannot mechanically prevent arming of the S&A device, and cannot mechanically prevent movement of said switch member from said APP to said AEP.

Additionally or alternatively, for example, the safety device further comprises a positional sensor system including at least one emitter sensor set configured for sensing at least one said position of the switch member, each said emitter sensor set comprising an emitter and a sensor aligned therewith along a first axis, wherein movement of the switch member between the APP and AEP either allows or blocks sensing by the sensor of emissions emitted by the emitter.

In at least a second example according to the first aspect of the presently disclosed subject matter the safety device comprises:

- a switch member, configured for mounting the S&A device thereto, said switch member being movable between at least two switch positions while carrying the S&A device therewith, said at least two switch positions including:
  - a first switch position, being an arming prevention position (APP), in which arming communication between the munition explosive and the S&A device is prevented; and
  - a second switch position, being an arming enabling position (AEP), in which arming communication between the munition explosive and the S&A device is allowed;
- an actuation mechanism for selectively moving said switch member at least from said APP to said AEP to thereby enable the S&A device, when armed, to detonate the munition explosive via the switch member.

In at least some examples, the safety device further comprises a marker element, wherein the marker element is configured for providing an externally observable indication corresponding to the switch member being in at least one of said switch positions.

Additionally or alternatively, the second example of the safety device can include one or more of the features disclosed above for the first example, mutatis mutandis.

According to a second aspect of the presently disclosed subject matter there is disclosed a munition, in which a first example thereof comprises:

- a munition explosive;
- a safe and arm (S&A) device for activation of munition explosive;
- a safety device as defined herein with respect to the aforesaid first aspect of the presently disclosed subject matter.

According to the second aspect of the presently disclosed subject matter, a second example of the munition comprises:

- a munition explosive;
- a safe and arm (S&A) device for activation of munition explosive;
- a safety mechanism comprising:
  - a switch member, configured for mounting the S&A device thereto, said switch member being movable with the S&A device between at least two positions including:
    - an arming prevention position (APP), in which arming communication between the munition explosive and the S&A device is prevented; and
    - an arming enabling position (AEP), in which arming communication between the munition explosive and the S&A device is allowed;

an actuation mechanism for selectively moving said switch member at least from said APP to said AEP to thereby enable the S&A device, when armed, to detonate the munition explosive.

The first or second examples of the munition according to the second aspect of the presently disclosed subject matter can include one or more of the following features.

For example, said S&A device is a stand-alone component configured for providing safety and arming functions to the munition explosive also in the absence of said safety device.

Additionally or alternatively, for example, the S&A device comprises a detonator spaced from an output lead by a barrier member having a barrier portion and a transfer lead portion.

Additionally or alternatively, for example, the S&A device is different from said safety device.

Additionally or alternatively, for example, the munition explosive comprises at least one grenade.

Additionally or alternatively, for example, the munition explosive comprises a plurality of grenades.

Additionally or alternatively, for example, the munition explosive comprises a warhead.

According to a third aspect of the presently disclosed subject matter there is disclosed a vehicle, configured for motion, and comprising a munition as defined herein with respect to the aforesaid second aspect of the presently disclosed subject matter.

For example, the vehicle is an air vehicle, configured for motion in the atmosphere.

Additionally or alternatively, for example, the vehicle is any one of an unmanned air vehicle (UAV), a missile, or a free-fall weapon.

Additionally or alternatively, for example, the vehicle is any one of a torpedo, a robotic land surface or a water surface vehicle.

Additionally or alternatively, for example, the vehicle is in the form of a quadcopter.

According to a third aspect of the presently disclosed subject matter there is disclosed a method for operating a munition, comprising:

(a) deploying the munition, the munition being as defined herein with respect to the aforesaid second aspect of the presently disclosed subject matter;
(b) selectively moving said switch member from said APP to said AEP;
(c) arming the S&A device;
(d) causing the S&A device to detonate the munition explosive via the switch member.

For example, the method comprises disengaging a Remove Before Operation (RBO) pin prior to step (b).

Additionally or alternatively, for example, the method comprises aborting deployment of the munition after step (a) and before step (b), and recovering the munition with said switch member at said APP.

Additionally or alternatively, for example, the method comprises aborting deployment of the munition after step (b) and before step (c). The method can also include the step of selectively moving said switch member from said AEP to said APP, and the step of recovering the munition with said switch member at said APP.

Additionally or alternatively, for example, the method comprises aborting deployment of the munition after step (c) and before step (d). The method can also include the step of disarming the S&A device into safe mode, the step of selectively moving said switch member from said AEP to said APP, and the step of recovering the munition with said switch member at said APP.

According to some aspects of the presently disclosed subject matter, examples of safety devices for use with a munition are provided, the munition including a munition explosive and a safe and arm (S&A) device for activation of the munition explosive. In some such examples the safety device includes a switch member and an actuation mechanism. The switch member is configured for being disposed between the munition explosive and the S&A device, the switch member being movable between at least two switch positions. In a first switch position (an arming prevention position (APP)), arming communication between the munition explosive and the S&A device is prevented. In a second switch position (an arming enabling position (AEP)), arming communication between the munition explosive and the S&A device is allowed. The actuation mechanism is configured for selectively moving the switch member at least from the APP to the AEP to thereby enable the S&A device, when armed, to detonate the munition explosive via the switch member.

A feature of at least one example of the presently discloses subject matter is that recovery of unused munition can be possible in a safe manner.

Another feature of at least one example of the presently discloses subject matter is that recovery of unused munition can be possible in a verifiably safe manner.

Another feature of at least one example of the presently discloses subject matter is that is provides an independent safety measure to a munition that provides visual confirmation of the munition being in a safe configuration and/or visual confirmation of the munition being in a potentially armed or actually armed configuration.

Another feature of at least one example of the presently discloses subject matter is that is provides an independent safety measure to a munition that allows for visual determination of the safety state of the munition from a safe distance.

Another feature of at least one example of the presently discloses subject matter is that it provides a visual marker that corresponds to the safety state of the munition with very high degree of reliability.

Another feature of at least one example of the presently discloses subject matter is that it provides a visual marker that corresponds to the safety state of the munition with close to absolute degree of reliability.

Another feature of at least one example of the presently discloses subject matter is that it provides a delivery vehicle configured for delivering a warhead to a desired target, and at the same time is configured for allowing the recovery of the delivery vehicle in a safe manner in situations where such delivery is aborted.

Another feature of at least one example of the presently discloses subject matter is that it provides a suicide delivery vehicle configured for delivering a warhead to a desired target, the delivery vehicle being destroyed or damaged in the process, and at the same time is configured for allowing the recovery of the delivery vehicle in a safe manner in situations where such delivery is aborted.

BRIEF DESCRIPTION OF THE DRAWINGS

In order to better understand the subject matter that is disclosed herein and to exemplify how it can be carried out in practice, embodiments will now be described, by way of non-limiting example only, with reference to the accompanying drawings, in which:

FIG. 3(*b*) illustrates in side view a munition including a safety device according to another example of the presently disclosed subject matter.

FIG. 4(*b*) illustrates in side view the example of FIG. 4(*a*), the safety device being in arming enabling mode.

FIG. 5(*b*) illustrates in side view the example of FIG. 5(*a*), the safety device being in arming enabling mode.

FIG. 6(*b*) illustrates in side view a munition including a safety device according to another example of the presently disclosed subject matter.

FIG. 7(*b*) illustrates in side view the example of FIG. 7(*a*), the safety device being in arming enabling mode.

FIG. 9(*b*) illustrates in isometric view the example of FIG. 9(*a*), the safety device being in arming enabling mode.

FIG. 10(*b*) illustrates in cross-sectional side view the example of FIG. 10(*a*), the safety device being in arming enabling mode.

FIG. 11(*b*) illustrates in aft view the example of FIG. 11(*a*), the safety device being in arming enabling mode.

FIG. 17(*b*) illustrates in side view the example of FIG. 17(*a*), the safety device being in arming enabling mode.

DETAILED DESCRIPTION

Figure 1:
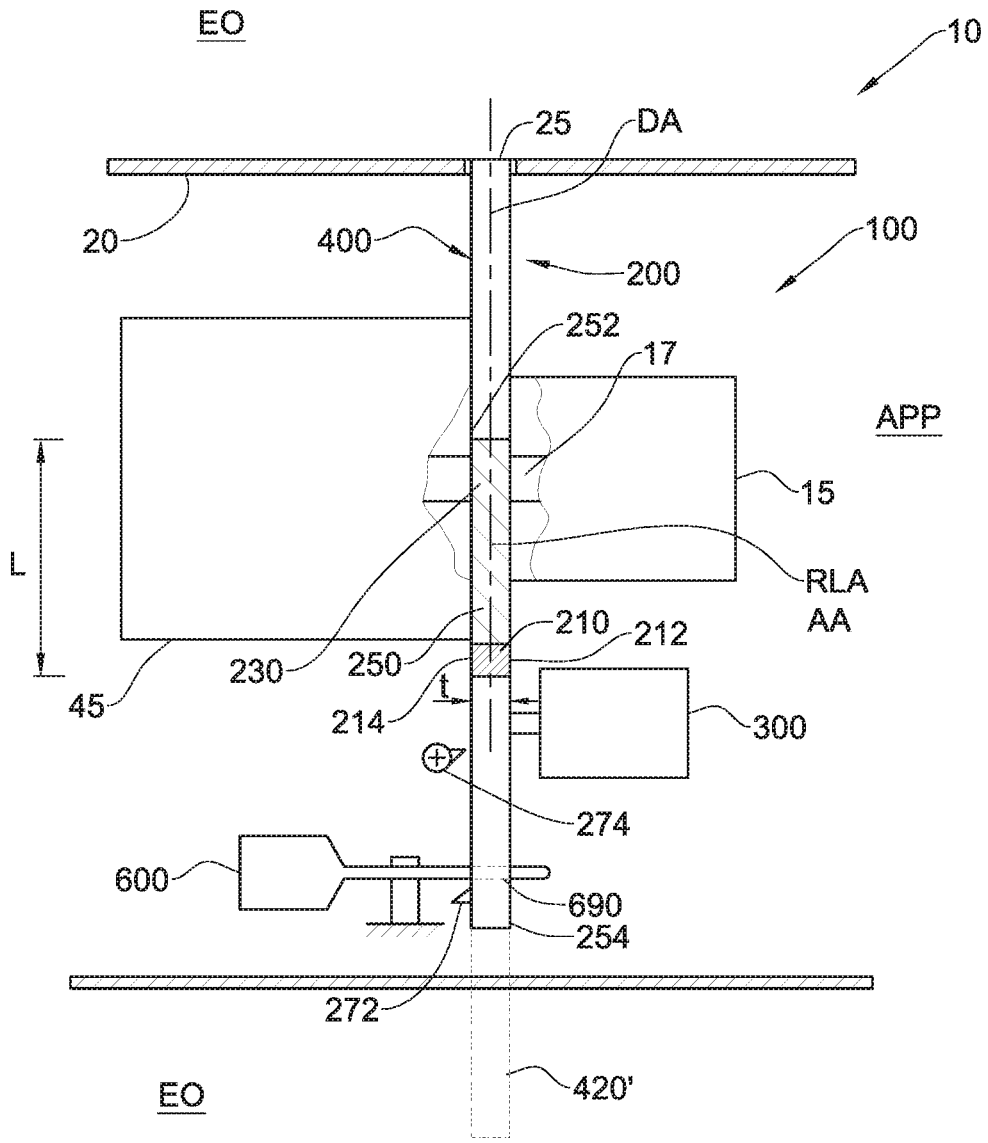
FIG. 1 illustrates in side view a munition including a safety device according to a first example of the presently disclosed subject matter, the safety device being in arming prevention mode.
Figure 2:
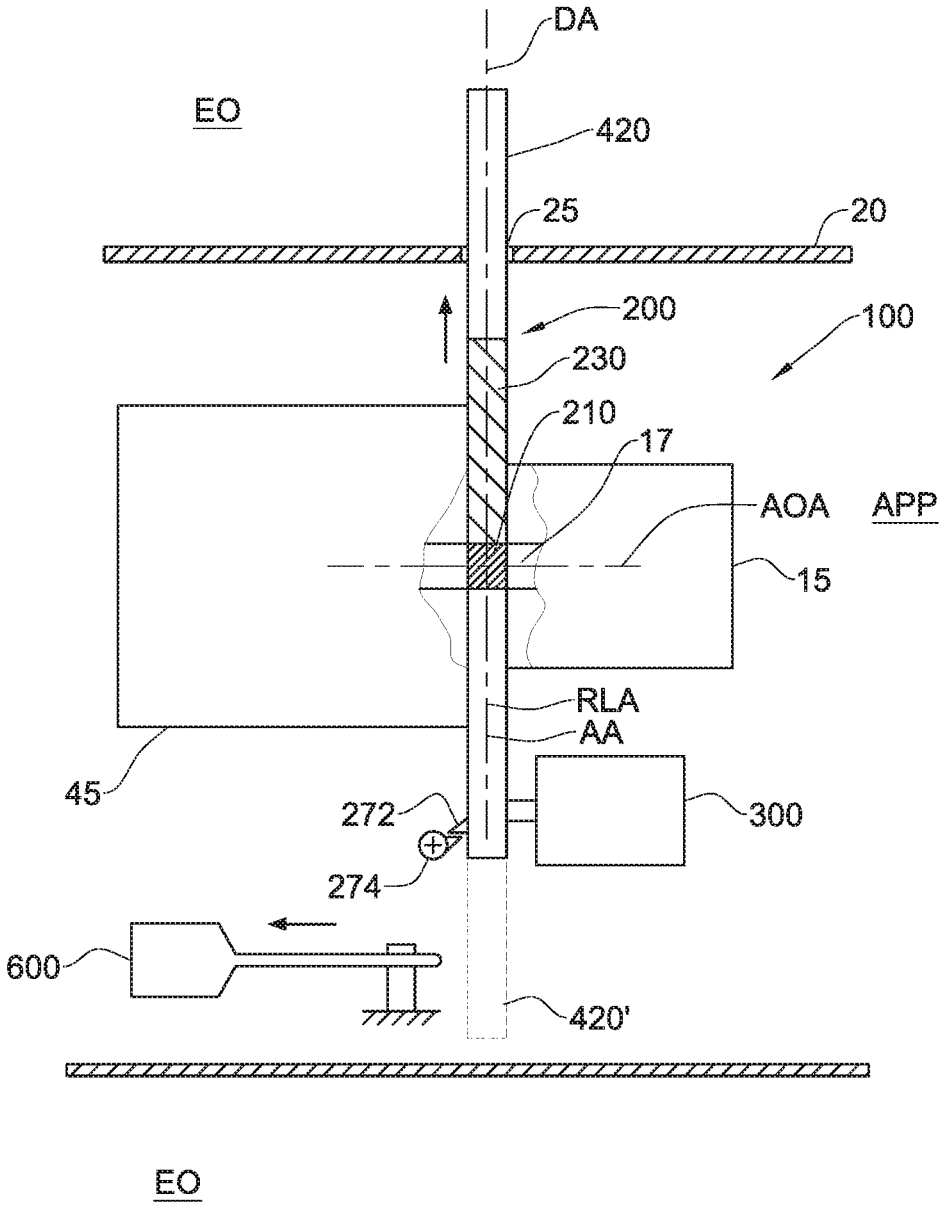
FIG. 2 illustrates in side view the example of FIG. 1, the safety device being in arming enabling mode.

Referring to FIGS. 1 and 2, a safety device for a munition 10 according to a first example of the presently disclosed subject matter, generally designated 100, comprises a switch member 200 and an actuation mechanism 300.

The munition 10 includes a safety and arming (S&A) device 15 and a munitions explosive 45, which includes the main explosive charge of the munition, which in this example is a chemical explosive munition of a warhead. In this example the munition explosive 45 comprises chemical explosives, which when detonated create a destructive heat and pressure wave. In alternative variations of this example, the warhead can include the munition in the form of any one of chemical weapons, biological weapons, nuclear weapons, hollow charge weapons, and so on.

The S&A device 15 is a stand-alone component, i.e. a self-contained component, and comprises at least a detonator (not shown), an S&A output lead 17, and an S&A barrier member (not shown) having a S&A transfer lead.

Conventionally, such an S&A device 15 can be directly coupled to the munitions explosive 45, and at least one example of S&A device 15 thereby provides in such an arrangement:

(a) a safety setting to the munitions explosive 45 when the S&A barrier member blocks the S&A output lead 17 from the munitions explosive 45; or (b) arms the munitions explosive 45 when the S&A barrier member aligns the S&A transfer lead between the detonator and the S&A output lead 17.

Furthermore, at least one example of the S&A device 15 can have a number of functions, including for example one or more of the following:

keeping the munitions explosive 45 from arming during shipping, handling or storage;

arming the munitions explosive 45 when a predetermined set of conditions is met;

causing munitions explosive 45 to detonate when hitting the target or at predetermined distance therefrom.

There are numerous examples of such S&A devices known in the art, and thus the S&A device 15 will not be described further herein.

According to the presently disclosed subject matter, the S&A device 15 can retain its conventional structure and functions, but rather than being coupled directly to the munitions explosives 45, the S&A device 15 and the munitions explosives 45 are separated from one another via the safety device 100.

The safety device 100 is thus different from, and operates independently of, the S&A device 15.

In this example, the S&A device 15 is fixedly mounted with respect to the munition 10, and in particular with respect to the munitions explosives 45. The switch member 200 is disposed between the S&A device 15 and the munitions explosives 45. Furthermore, the switch member 200 is movable between at least two switch positions:

an arming prevention position (APP), for example as illustrated in FIG. 1, corresponding to a safety device arming prevention mode; and an arming enabling position (AEP), for example as illustrated in FIG. 2, corresponding to a safety device arming enabling mode.

In the arming prevention position (APP), corresponding to an arming prevention mode for the safety device 100, arming communication between the munition explosive 45 and the S&A device 15 is blocked or otherwise prevented.

In the arming enabling position (AEP), corresponding to an arming enabling mode for the safety device 100, arming communication between the munition explosive 45 and the S&A device 15 is allowed, i.e., the munition explosive 45 and the S&A device 15 are in arming communication i.e., in arming contact.

The term "arming communication" as used herein refers to the type of communication or contact between the munition explosive 45 and the S&A device 15 (via the safety device 100, in particular via the switch member 200) that is such as to establish a contiguous explosive train between the S&A device 15 and the munition explosive 45 of the warhead. For example, when "arming communication" is established between the S&A device 15 and the munition explosive 45, this allows a detonation wave to travel from the S&A device 15 to the munition explosive 45 and thereby cause the munition explosives 45 to explode. Conversely, blocking or otherwise preventing "arming communication" between the munition explosive 45 and the S&A device 15 (via the safety device 100, in particular via the switch member 200), refers to interrupting the explosive train between the S&A device 15 and the munition explosive 45, and thus, for example, a detonation wave originating from the S&A device 15 is prevented from traveling to the munition explosive 45 and the detonation wave is thereby not able to reach or cause the munition explosives 45 to explode.

Furthermore in this example, the switch member 200 is the form of an elongate rod 250 (also referred to herein as a slider), having a rod longitudinal axis RLA, and comprises a transfer lead portion 210 longitudinally spaced from a blocking portion 230 along the rod longitudinal axis RLA. The rod 250 has a first longitudinal end 252 and a second longitudinal end 254, and at least in this example also has a substantially uniform transverse thickness t, at least along a minimum longitudinal length L thereof including the transfer lead portion 210 and the blocking portion 230 wherein said length L is disposed between the first longitudinal end 252 and the second longitudinal end 254.

The transfer lead portion 210 is configured for selectively being in arming contact with, and to thereby provide arming communication between, the munition explosive 45 and the S&A device 15 when the switch member 200 is at the AEP (see FIG. 2). The transfer lead portion 210 thus extends through the transverse thickness t of the rod 250, and has a first face 212 transversely spaced from a second face 214, the first face 212 generally facing towards the S&A device 15, and the second face 214 generally facing towards the munition explosive 45. The transfer lead portion 210 is made from any suitable material that is configured for allowing arming communication between the munition explosive 45 and the S&A device 15, transversely through the rod 250. For example, the transfer lead portion 210 can be made from the same material as the S&A output lead 17 of the S&A device 15. Examples of such materials for the transfer lead portion 210 can include, for example, PBXN-5, PA508, CH6, and so on, as known in the art.

Thus, in the AEP the munition explosive 45, the transfer lead portion 210 and the S&A device 15 are in-line, along axis of arming AOA.

The blocking portion 230 is configured to block arming contact with, and to thereby prevent arming communication between, the munition explosive 45 and the S&A device 15 when the switch member 200 is at the APP (see FIG. 1). The blocking portion 230 can extend through all of or part of transverse thickness t of the rod 250, and extends longitudinally and/or laterally sufficiently to ensure that at the APP the munition explosive 45 is out of line with respect to the S&A device 15 until the transfer lead portion 210 is aligned with the S&A output lead 17 of the S&A device 15. The blocking portion 230 is made from any suitable material that is configured for blocking arming communication between the munition explosive 45 and the S&A device 15, transversely through the rod 250, at the APP. For example, the blocking portion 230 can be made from any suitable barrier material that does not allow propagation of a detonation wave therethrough. Examples of such materials for the blocking portion 230 can include, for example, ceramics, metals (for example steel), and other materials as well known in the art.

The rod 250 can be made from a material different from that of the blocking portion 230 and from that of the transfer lead portion 210, and the blocking portion 230 and of the transfer lead portion 210 are embedded in the rod 250, for example as plugs of the respective materials. Alternatively, the rod 250 can be made from the same material different as the blocking portion 230 and can be made integral therewith; the transfer lead portion 210 can then be embedded in the rod 250, for example as plug of the respective material.

In this example, in operation the switch member 200 is movable from the APP to the AEP in a linear motion along an activation axis AA. In particular, the rod 250 is slidably movable from APP to the AEP in a linear motion along activation axis AA, which is parallel or coaxial with the rod longitudinal axis RLA. The safety device 100 comprises suitable slide rails or guides (not shown) or any other suitable arrangement to allow sliding of the rod 250 between the APP and the AEP.

To enhance the safety feature aspect of the switch member 200, the transfer lead portion 210 can optionally be designed to be as small as possible with respect to the output lead 17 of the S&A device 15, so that only when the switch member is in the AEP is it possible for the S&A device 15 to detonate the munition, i.e., when the transfer lead portion 210 and the output lead 17 are coaxially aligned along axis AOA (FIG. 2). In such a case, the safety device 100 is essentially in safe mode even when the switch is moved away from the APP, and at virtually all other positions intermediate the APP and the AEP, except for the actual AEP itself.

The actuation mechanism 300 is configured for selectively moving the switch member 200 at least from the APP to the AEP to thereby enable the S&A device 15, when armed, to detonate the munition explosive 45 via the switch member 200. For example, the actuation mechanism 300 comprises an electric motor 260 operatively connected to the switch member 200, and a suitable power source (e.g. a battery) is operatively connected to the motor. For example, the motor can be operatively connected to the rod 250 via a rack and pinion arrangement, the motor turning the pinion, and the rack being affixed to or integral with the rod 250. Actuation of the motor rotates the pinion, which in turn moves the rod 250 between the APP and the AEP. For example the rack can be provided on a side edge of the switch member 200. Optionally, the rack can include a cut-out portion such that when the switch member 200 is translated via rotation of the pinion gear, when the cut-out portion reaches the position of the pinion gear, the pinion gear becomes disengaged with the rack and thus prevents further displacement of the switch member 200 even if the pinion gear is still rotating. This can help ensure that switch member 200 remains in the AEP and that concurrently the marker element 400 (see below) remains visible.

Alternatively, in this example, and in at least some alternative variations of this example and in other examples of the presently disclosed subject matter, actuation mechanism 300 can be based on a linear actuator or a rotary actuator, and can comprise for example any one of:

- a linear actuator, for example a solenoid or other linear motor, operatively connected to a suitable power source (e.g. a battery), and connected directly or indirectly (for example via a lever system) to the rod 250, such that actuation of the solenoid or other linear motor moves the rod 250 from the APP to the AEP.
- a rotary actuator, for example a rotary motor, operatively connected to a suitable power source (e.g. a battery), and connected directly or indirectly (for example via a rack and pinion gear system) to the rod 250, such that actuation of the rotary motor moves the rod 250 from the APP to the AEP.
- a linear actuator, for example a pyrotechnic actuator coupled to a piston arrangement (having a piston movable within a housing) and connected to a suitable power source (e.g. a battery); the piston arrangement is connected directly or indirectly (for example via a lever system) to the rod 250, such that actuation of the pyrotechnic actuator causes the piston to move relative to the housing, thereby moving the rod 250 from the APP to the AEP.
- a linear actuator, for example a pneumatic actuator or a hydraulic actuator, coupled to a piston arrangement (having a piston movable within a housing) and connected to a suitable compressed gas source or hydraulic liquid source, respectively; the piston arrangement is connected directly or indirectly (for example via a lever system) to the rod 250, such that actuation of the actuator causes the piston to move relative to the housing, thereby moving the rod 250 from the APP to the AEP.
- a linear actuator, for example a thermal actuator, having a piston arrangement (the piston movable within a housing of the actuator) and connected to a suitable power source (e.g. a battery); the piston arrangement is connected directly or indirectly (for example via a lever system) to the rod 250, such that actuation of the thermal actuator heats up the thermal material (for example a wax) inside thereof and causes the piston to move relative to the housing, thereby moving the rod 250 from the APP to the AEP.
- a linear or rotary actuator, for example a compressed spring arrangement having a lock pin that keeps the spring compressed until actuated; the lock pin can be, for example, in the form of an explosive bolt, or is shearable or otherwise removable responsive to said actuation, allowing the spring to expand, thereby moving the rod 250 from the APP to the AEP.

Optionally, the safety device 100 comprises a lock mechanism for reversibly or irreversibly locking the switch member 200 at the AEP after it has moved from the APP. For example, such a lock mechanism can comprise a mechanical stop, for example in the form of a wedge 272, affixed to the rod 250 and moveable therewith, and includes a pawl 274 provided at a fixed position. As the rod 250 slides from the APP to the AEP, the pawl is deflected by the wedge 272 and pivots in a counter clockwise direction (as seen in FIGS. 1 and 2). However, the pawl is configured to return to its initial position, and can comprise another mechanical stop (not shown) so that it is limited from pivoting in clockwise direction only to its initial position, and thus prevents the rod 250, via the wedge 272, from returning to the APP. In alternative variations of this example and in other examples of the presently disclosed subject matter, other configurations can be provided for the lock mechanism, or alternatively, the lock mechanism can be omitted.

Further optionally, the lock mechanism is reversibly lockable, and thus can be manually unlocked (e.g. once the munition 10 is recovered), and thus allow the switch member 200 to be moved back from the AEP to the APP, for example manually. In such a case, the lock mechanism can be, for example, in the form of a clutch having a spherical member urged against the switch member 200 via a spring, wherein in the AEP the spherical member is engaged in an indentation provided in the switch member 200, wherein by manually pushing the switch member 200 towards the APP causes the spherical member to become disengaged from the indentation.

According to another aspect of the presently disclosed subject matter, the safety device 100 further comprises a marker element 400 for alerting an external observer EO as to the position of the switch mechanism 200. In other words, the marker element 400 is configured for providing an externally observable indication, i.e. a marker or indication to an external observer EO, that correspondingly relates to the position of the switch mechanism 200, in particular as relating to the AEP and/or to the APP.

In general, the marker element 400 can be configured to enable the external observer to be alerted to any one of the following conditions:

(A) that the switch member 200 is at the APP concurrent with the switch member 200 being at the APP;

(B) that said switch member 200 is at the AEP concurrent with the switch member being at the AEP;

(C) that the switch member 200 is at the APP concurrent with the switch member 200 being at the APP; and, that the switch member 200 is at said AEP concurrent with the switch member 200 being at the AEP.

In this example, and in at least some alternative variations of this example and in other examples of the presently disclosed subject matter, the marker element 400 is in the form of a visual marker that is configured for enabling an external observer to be visually alerted as to the position of the switch mechanism 200.

Furthermore, in at least this example, and in at least some alternative variations of this example and in other examples of the presently disclosed subject matter, the marker element 400 is configured for condition (B), i.e., when the switch member 200 is in the AEP the marker element 400 is externally observable, i.e. under conditions in which the S&A device 15 can potentially arm the munition explosive 45.

In this example the marker element 400 comprises a rod member 420 that is deployable from a retracted position to an exposed deployed position. In the retracted position the rod member 420 is not externally visible, and corresponds to the APP. In the deployed position the rod member 420 is externally visible, and corresponds to the AEP.

In this example, in operation the rod member 420 is linearly deployable or movable from the retracted position to the deployed position in a linear motion along a deployment axis DA, and the safety device 100 comprises suitable slide rails or guides (not shown) or any other suitable arrangement to allow the aforesaid linear motion of the rod member 420. Also in this example, in the retracted position the rod member 420 is enclosed in a housing 20 and thereby not externally observable, while in the deployed position the rod member 420 projects outside of the housing 20 via opening 25 and is thereby externally observable.

In this example and in other examples where the munition 10 is deployed as a self-contained unit—for example in the form of a missile, or a free-fall weapon, torpedo, robotic land surface or water surface vehicle, and so on—the housing 20 can be part of an external wall or external casing of the munition 10 itself, such an external wall being observable by an external observer EO from an outside of the munition 10.

In at least some alternative variations of this example and in other examples of the presently disclosed subject matter, the munition is carried by a carrier vehicle, for example, a UAV, up to and including detonation. In such cases the carrier vehicle is designed to be sacrificed, and is also referred to herein as a "kamikaze" vehicle. In such cases the housing 20 can be part of an external wall of the carrier vehicle, such an external wall being observable by an external observer EO from an outside of the carrier vehicle.

Thus, the retracted position corresponds to the APP, while the deployed position corresponds to the AEP.

Furthermore, the switch member 200 and the marker element 400 are configured as a kinematic pair, such that when the switch member 200 moves from the APP to the AEP, the marker element 400 correspondingly moves from the retracted position to the deployed position.

In this example, the deployment axis DA of the marker element 400 is parallel to or coaxial with the activation axis AA of the switch member 200. Furthermore in this example, the rod member 420 is affixed to, or integrally formed with, the rod 250, at the first end 252 of the rod 250, and thus the rod member 420 and the rod 250 move as a single rigid body. Thus as the switch member 200 from the APP to the AEP, the marker element 400 concurrently moves from the retracted position to the deployed position along the same actuation axis AA.

Furthermore, in this example, the marker element moves 400 in the same direction as the switch member 200. However, in alternative variations of this example, and referring to FIG. 3(*a*), the marker element 400 moves along the deployment axis DA in the opposite direction with respect to the switch member 200, and the deployment axis DA is parallel to the actuation axis AA. For example, the safety device 100 comprises a double rack and pinion arrangement, including a first rack gear 201 affixed to the marker element 400, a second rack gear 202 affixed to the switch member 200, and a pinion gear 203 rotatable about pinion axis 205.

Figure 3A:
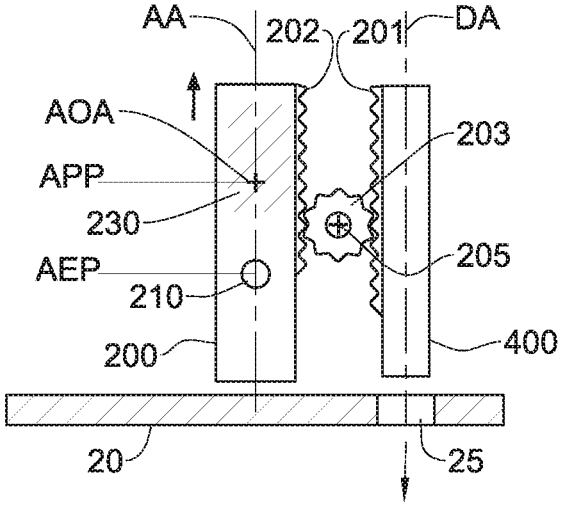
FIG. 3(*a*) illustrates in side view a munition including a safety device according to another example of the presently disclosed subject matter.
Figure 3B:
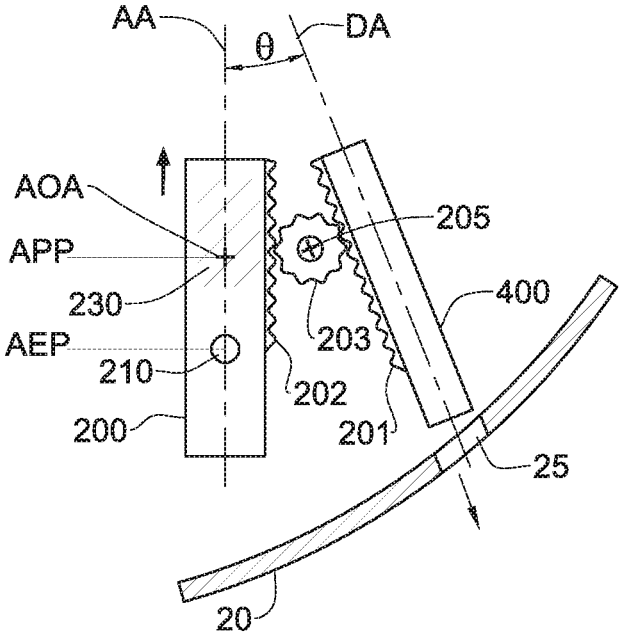

In yet other alternative variations of this example, and referring to FIG. 3(*b*), the marker element moves 400 along the deployment axis DA with respect to the switch member 200, wherein the deployment axis DA is at an angle θ to the actuation axis AA, where angle θ can be any angle in the range 0° to 360°. For example, and as with the example of FIG. 3(*a*), the safety device 100 comprises, for example, a double rack and pinion arrangement, including first rack gear 201 affixed to the marker element 400, second rack gear 202 affixed to the switch member 200, and pinion gear 203 rotatable about pinion axis 205. In some such cases, and depending on the relative sizes of the marker element 400 and the switch member 200, on the magnitude of the angle θ, and the linear travel of the marker element 400 and the switch member 200 between positions APP and AEP, the marker element 400 is spaced from the switch member 200 in a direction along the pinion axis 205 sufficient to avoid collision between the marker element 400 and the switch member 200.

In any case, and to enhance visibility of the marker element 400 in the deployed position, the marker element (e.g. the rod member 420) can be integrally formed with or can be coated in bright color (e.g. red paint), and/or in fluorescent colors, and/or can comprises a highly reflective coating, for example retro-reflective tape.

In alternative variations of this example, the deployment axis DA of the marker element 400 is not parallel to the activation axis AA of the switch member 200. Rather, the marker element 400 and the switch member 200 form a kinematic pair via a mechanical connection, for example levers pivotably mounted to the marker element 400 and to the switch member 200.

In yet other alternative variations of this example and in other examples of the presently disclosed subject matter, the marker element 400 is configured for condition (A), i.e., when the switch member 200 is in the APP the marker element 400 is externally visible, under conditions in which the S&A device 15 is prevented from arming the munition explosive 45 via the switch member 200. In such cases, and referring again to FIGS. 1 and 2, the marker element 400 can also comprise a rod member 420' (for example similar to rod member 420, mutatis mutandis) that is deployable from a retracted position to an exposed deployed position. In the retracted position the rod member is not externally visible, and corresponds to the AEP, while in the deployed position the rod member is externally visible, and corresponds to the APP—the rod member 420' is shown at these positions as dotted lines 420' in FIGS. 1 and 2. Also in this example, in operation the rod member 420' is linearly deployable or movable from the retracted position to the deployed position in a linear motion along a deployment axis DA, and the safety device 100 comprises suitable slide rails or guides (not shown) or any other suitable arrangement to allow the aforesaid linear motion of the rod member. Also in this example, in the retracted position the rod member is enclosed in housing 20 and thereby not externally observable, while in the deployed position the rod member 420 projects outside of the housing 20 via opening 25 and is thereby externally observable. Furthermore, in this example, the rod member is affixed to, or integrally formed with, the rod 250, at the second end 254 of the rod 250. Thus as the switch member 200 from the APP to the AEP, the marker element 400 concurrently moves from the deployed position to the retracted position along the same actuation axis AA. In alternative variations of this example, the deployment axis DA of the marker element 400 is not parallel to the activation axis AA of the switch member 200, and/or the marker element 400 and the switch element 200 move in different directions from one another, for example as described above with respect to FIGS. 3(*a*) and 3(*b*), mutatis mutandis.

In yet other alternative variations of this example and in other examples of the presently disclosed subject matter, the marker element 400 is configured for condition (C), i.e.:

when the switch member 200 is in the APP the marker element 400 is externally visible, under conditions in which the S&A device 15 is prevented from arming the munition explosive 45 via the switch member 200;

and when the switch member 200 is in the AEP the marker element 400 is also externally visible, under conditions in which the S&A device 15 can potentially arm the munition explosive 45.

In such cases, the marker element 400 can also comprise a rod member 420 as well as rod member 420', as disclosed above for the corresponding examples relating to condition (B) and condition (A), mutatis mutandis. Thus, rod member 420 is deployable from a retracted position to an exposed deployed position, while concurrently rod member 420' is retractable from an exposed position to a retracted position, while concurrently the switch member is moved from the APP to the AEP. Thus, in the APP only the rod member 420' is externally visible, while in the AEP only the rod member 420 is externally visible. To differentiate between the AEP and the APP, the rod member 420 in its corresponding deployed position is visually distinguishable from the rod member 420' in its corresponding deployed position. For example the rod member 420 can have a red color while the rod member 420' can have a green color, and/or, the rod member 420 can have a first geometrical shape, while the rod member 420' can have a second geometrical shape that is visually very different from the first geometrical shape. In this example, the rod member 420 and the rod member 420' are each kinematically coupled to the switch member 200, and each one of the rod member 420 and the rod member 420' can be linearly deployed along the same or different axes with respect to each other or with respect to the switch member 200.

In these or other alternative variations of this example, in operation the marker element 400 is pivotably deployable or movable from the retracted position to the deployed position in a pivotable motion about a deployment pivot axis, and the safety device 100 comprises suitable journals, bearings or other pivoting structure or any other suitable arrangement to allow the aforesaid pivotable motion of the marker element 400. The marker element 400 can be in the form of a disc or segment of a disc, or a portion of a spherical surface, for example, in which the center of the corresponding disc or sphere is on the deployment pivot axis.

For example, and alternatively for each of the examples disclosed above regarding conditions (A), (B) and (C), while the switch member 200 is actuated to move linearly from the APP to the AEP along actuation axis AA, and the marker element 400 concurrently moves along deployment axis DA, other arrangements are also possible. For example, referring to FIGS. 4(*a*) and 4(*b*), the safety device 100 can be instead configured such that as the switch member 200 is actuated to move linearly from the APP to the AEP along actuation axis AA, the marker element 400 is pivotably retractable or movable from the deployed position to the retracted position in a pivotable motion about a deployment pivot axis DPA. For example, the safety device 100 comprises a rack and pinion arrangement, including a rack gear 231 affixed to the switch member 200, and a pinion gear 233 rotatable about a pinion gear axis, which in this example is coaxial with the deployment pivot axis DPA. In this example the marker element 400 is in the form of a disc sector 430, including for example more than 180° of the full disc, and having a perimeter including a circumferential portion 435 and a chord portion 436. The disc sector 430 also has flat faces 439, and disc center 438 which is coaxial with the deployment pivot axis DPA. The disc sector 430 is affixed to or integral with the pinion gear 233.

Figure 4A:
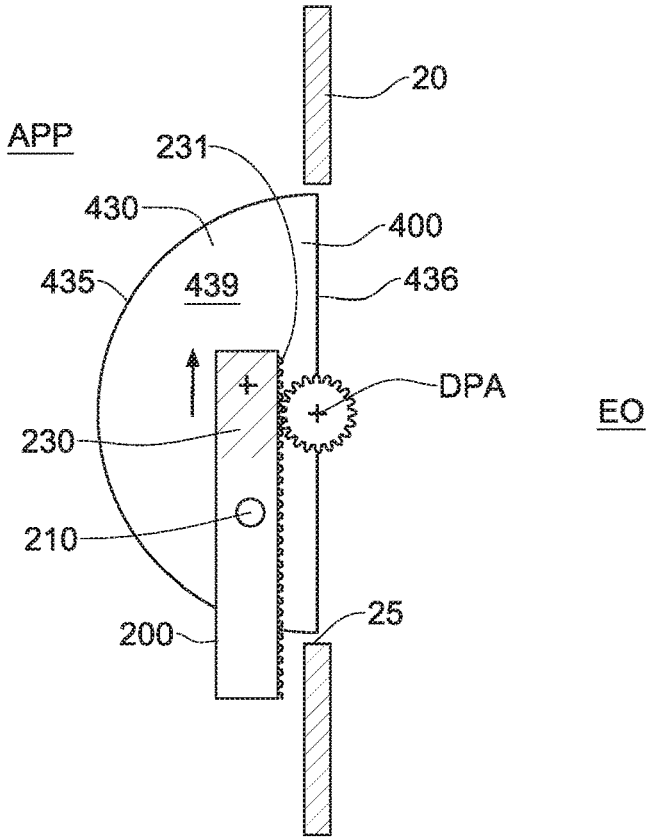
FIG. 4(*a*) illustrates in side view a munition including a safety device according to another example of the presently disclosed subject matter, the safety device being in arming prevention mode.
Figure 4B:
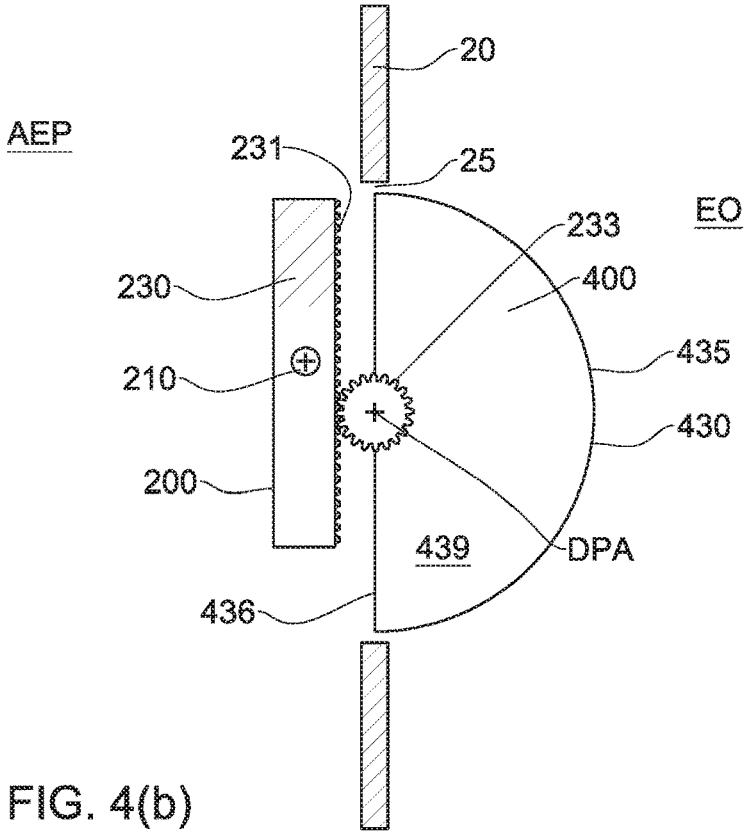

Referring still to FIGS. 4(*a*) and 4(*b*), in condition (B), as the switch member 200 is actuated to move linearly from the APP to the AEP along actuation axis AA, the rack and pinion arrangements causes the pinion gear 233 to rotate, thereby pivoting the disc sector 430 from the retracted position in housing 20 (FIG. 4(*a*)) to the deployed position outside of the housing 20 (FIG. 4(*b*)) in a pivotable motion about a deployment pivot axis DPA. In the deployed position, the faces 439 are projecting outside of the housing 20 and are clearly visible to an external observer OA outside of the housing 20, who can now be assured that the switch member 200 is in the AEP position.

Alternatively, in condition (A), the disc sector 430 is affixed to the pinion gear 233 in a relative angular orientation (for example displaced by 180° from the orientation shown in FIGS. 4(*a*) and 4(*b*)) such that in the APP, the disc sector 430 is in the deployed position, and thus the faces 439 are projecting outside of the housing 20 via opening 25 and are clearly visible to an external observer OA outside of the housing 20, who is now assured that the switch member 200 is in the APP position. As the switch member 200 is actuated to move linearly from the APP to the AEP along actuation axis AA, the rack and pinion arrangement causes the pinion gear 233 to rotate, but now pivoting the disc sector 430 from the deployed position outside housing 20 via opening 25 to the retracted position inside of the housing 20 via opening 25 in a pivotable motion about a deployment pivot axis DPA. In the retracted position, the faces 439 are no longer projecting outside of the housing 20 and this is clearly observable by an external observer OA outside of the housing 20, who can now be assured that the switch member 200 is in the AEP position.

Alternatively, in condition (C), the disc sector 430 is in the form of a full disc having two half-disc sectors marked therein, a first disc sector and a second disc sector. The full disc is affixed to the pinion gear 233 in a relative angular orientation such that in the APP, the first disc sector is in the deployed position while the second disc sector is in the retracted position, while in the AEP the first disc sector is in the retracted position while the second disc sector is in the deployed position. Thus, as the switch member 200 is actuated to move linearly from the APP to the AEP along actuation axis AA, the rack and pinion arrangement causes the pinion gear 233 to rotate, but now pivoting the full disc by 180° in which the first disc sector is retracted from the deployed position outside housing 20 to the retracted position inside of the housing 20 in a pivotable motion about a deployment pivot axis DPA, while concurrently the second disc sector is deployed from the retracted position in housing 20 to the deployed position projecting outside of the housing 20 via opening 25 in a pivotable motion about a deployment pivot axis DPA. In the APP position, the corresponding faces of the first disc sector are projecting outside of the housing 20 via opening 25 and this is clearly visible to an external observer OA outside of the housing 20, who is now assured that the switch member 200 is in the AEP position. In the AEP position, the corresponding faces of the second disc sector are projecting outside of the housing 20 via opening 25 and this is clearly visible to an external observer OA outside of the housing 20, who can now be assured that the switch member 200 is in the APP position. To differentiate between the AEP and the APP, the first disc segment in its corresponding deployed position is visually distinguishable from the second disc segment in its corresponding deployed position. For example the first disc segment and the second disc segment can have different colors—for example the first disc segment can have a red color while the second disc segment can have a green color, and/or, the first disc segment and the second disc segment can have different geometrical shapes—for example the first disc segment can have a first geometrical shape while the second disc segment can have a second geometrical shape that is visually very different from the first geometrical shape. For example the first geometric shape can be a full disc segment with continuous faces, while the second geometric shape can include a disc segment having a plurality of through-holes through the faces thereof. Alternatively for example, first geometric shape can be a full disc segment with continuous semi-circular edge, while the second geometric shape can include a disc segment having a star-shaped edge.

Figure 5A:
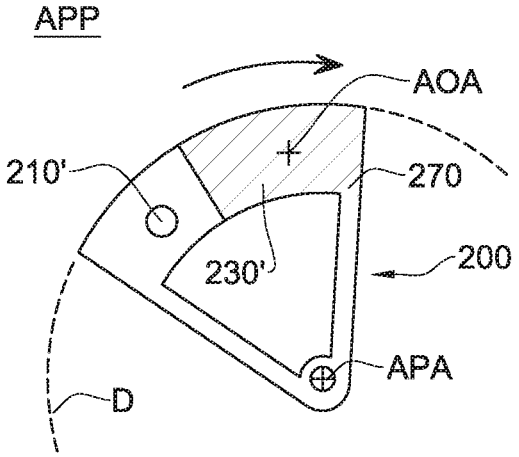
FIG. 5(*a*) illustrates in side view a switch member of a safety device according to another example of the presently disclosed subject matter, the safety device being in arming prevention mode.
Figure 5B:
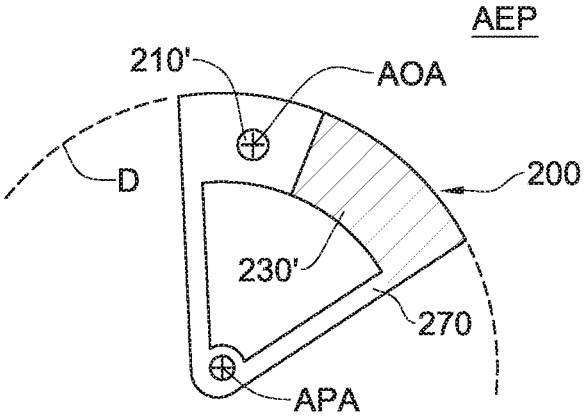

In yet other alternative variations of the above examples, and referring to FIGS. 5(*a*) and 5(*b*), in operation the switch member 200 is pivotably movable at least from the APP to the AEP in a pivotable motion (rather than in a linear motion) about an actuation pivot axis APA, and the safety device 100 comprises suitable journals, bearings or other pivoting structure or any other suitable arrangement to allow the aforesaid pivotable motion of the switch member 200. For example, the switch member 200 can be in the form of a disc or segment of a disc, for example disc element 270 which is a segment of an imaginary disc D, and in which actuation pivot axis APA passes through the center of the imaginary disc. In this example, the disc element 270 also comprises transfer lead portion 210' and blocking portion 230' which are respectively similar to the transfer lead portion 210 and the blocking portion 230 of the examples discussed above, mutatis mutandis, with a few differences, as follows. In the example of FIGS. 5(*a*) and 5(*b*), the transfer lead portion 210' is circumferentially spaced from a blocking portion 230' about the actuation pivot axis APA.

In this example, in operation the disc element 270 is movable from the APP to the AEP in a pivotal motion about an activation pivot axis APA, so that at the APP the blocking portion 230' blocks arming contact with, and thereby prevents arming communication between, the munition explosive 45 and the S&A device 15. In the AEP the transfer lead portion 210' is in-line with, and thus in arming contact with the munition explosive 45 and the S&A device 15 along axis AOA, to thereby provide arming communication between, the munition explosive 45 and the S&A device 15.

In the example of FIGS. 5(*a*) and 5(*b*), the disc element 270 is actuated by actuation mechanism 300 which can be similar to the examples disclosed above with respect to the rod 250, mutatis mutandis, with the main difference being that the actuation mechanism 300 is coupled to the disc element 270 to provide a pivoting motion thereof rather than a linear motion of the rod 250.

In the example of FIGS. 5(*a*) and 5(*b*), the disc element 270 is operatively coupled to the marker element 400 such that pivoting the APP to the AEP about an activation pivot axis APA causes the marker element 400 to be deployed and/or retracted to enable the external observer to be alerted to any one of conditions (A), (B) or (C), in a similar manner to the examples disclosed above, mutatis mutandis, with some differences as will become clearer below.

Figure 6A:
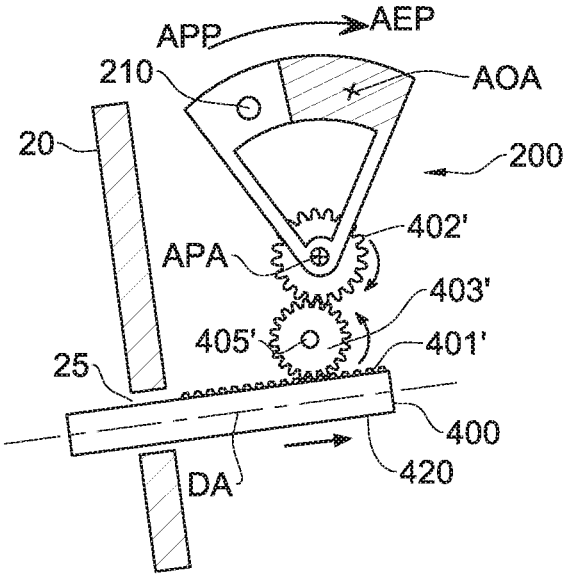
FIG. 6(*a*) illustrates in side view a munition including a safety device according to another example of the presently disclosed subject matter.
Figure 6B:
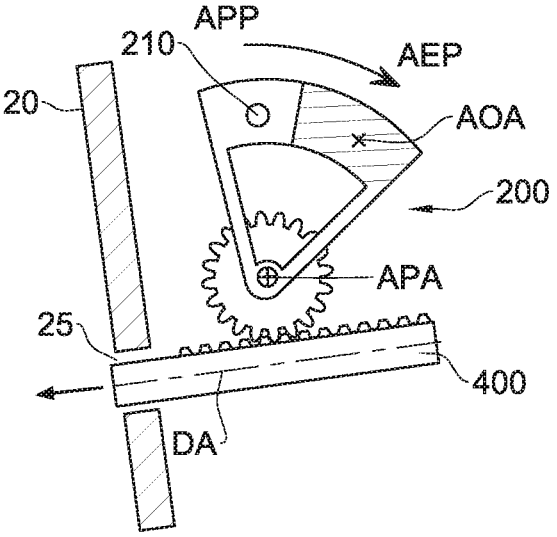

For example, referring to FIG. 6(*a*), in the illustrated example the element 400 is configured according to condition (A), in which the retracted position of the marker element 400 corresponds to the AEP, while the deployed position corresponds to the APP. Furthermore, the switch member 200 and the are configured as a kinematic pair, such that when the switch member 200 moves from the APP to the AEP, the marker element 400 moves from the deployed position to the retracted position. In this example, the deployment axis DA of the marker element 400 is orthogonal to the activation pivot axis APA of the switch member 200. Furthermore in this example, the rod member 420 comprises a rack and pinion arrangement, including a rack gear 401' affixed to the marker element 400, a first pinion gear 402' affixed to the switch member 200, and a second pinion gear 403' rotatable about pinion axis 405'. Thus as the switch member 200 pivots, in a clockwise position as seen in FIG. 6(*a*), from the APP to the AEP, the marker element 400 concurrently moves from the deployed position to the retracted position along the deployment axis DA from the deployed position to the retracted position.

Alternatively, the example of FIG. 6(*a*) can be configured according to condition (B), by configuring the switch member to pivot from the APP to the AEP, in a counter clockwise position as seen in FIG. 6(*a*).

In another example, and referring to FIG. 6(*b*), the element 400 is configured according to condition (B), in which the deployed position of the marker element 400 corresponds to the AEP, while the retracted position corresponds to the APP. Furthermore, the switch member 200 and the are configured as a kinematic pair, such that when the switch member 200 moves from the APP to the AEP, the marker element 400 moves from the retracted position to the deployed position. In this example, the deployment axis DA of the marker element 400 is orthogonal to the activation pivot axis APA of the switch member 200. Furthermore in this example, the rod member 420 comprises a rack and pinion arrangement, including a rack gear 401' affixed to the marker element 400, and a first pinion gear 402' affixed to the switch member 200. Thus as the switch member 200 pivots, in a clockwise position as seen in FIG. 6(*b*), from the APP to the AEP, the marker element 400 concurrently moves from the retracted position to the deployed position along the deployment axis DA from the deployed position to the retracted position.

Alternatively, the example of FIG. 6(*b*) can be configured according to condition (A), by configuring the switch member to pivot from the APP to the AEP, in a counter clockwise position as seen in FIG. 6(*a*).

Figure 7A:
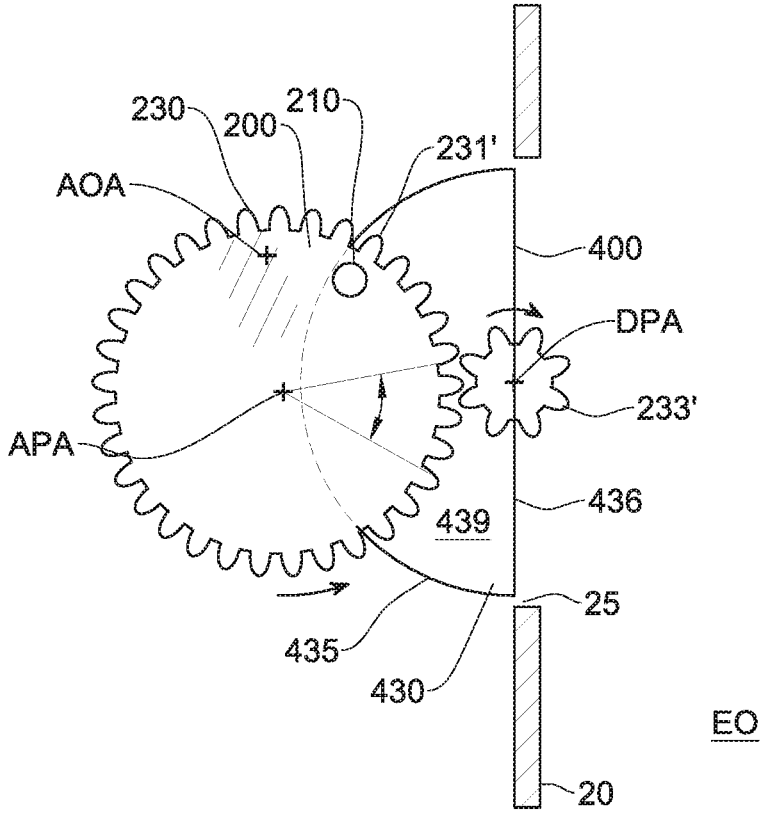
FIG. 7(*a*) illustrates in side view a switch member of a safety device according to another example of the presently disclosed subject matter, the safety device being in arming prevention mode.
Figure 7B:
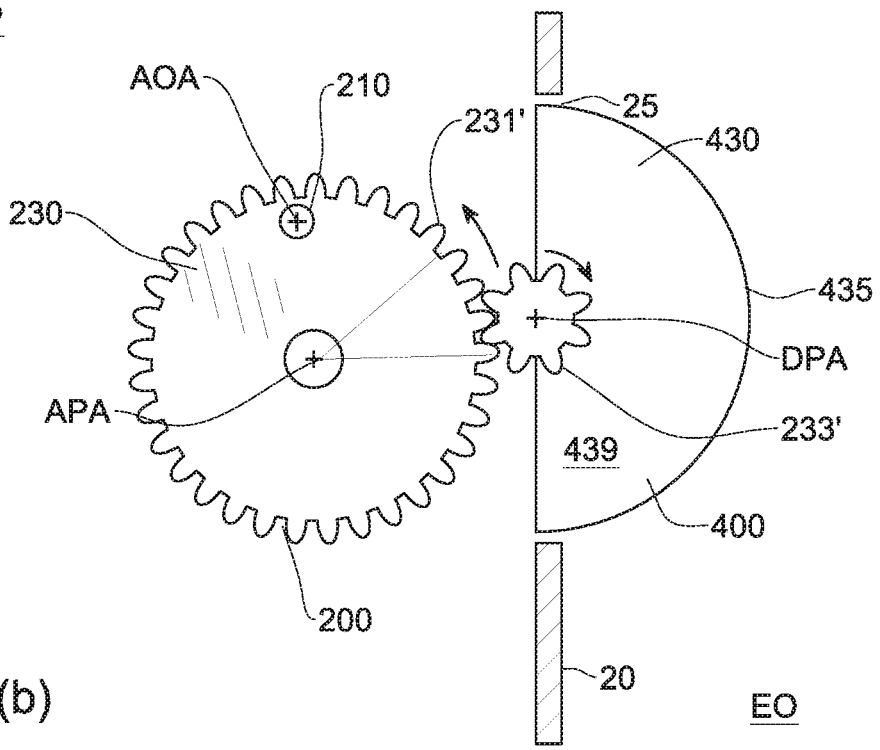

In another example, and referring to FIGS. 7(*a*) and 7(*b*), the safety device 100 can be configured such that as the switch member 200 is actuated to be movable at least from the APP to the AEP in a pivotable motion about activation pivot axis APA the marker element 400 is concurrently pivotably deployable or movable from the retracted position to the deployed position in a pivotable motion about a deployment pivot axis DPA. For example, the safety device 100 comprises pinion arrangement, for example gear teeth 231' about the periphery of the switch member 200, which can be in the form of a disc or part thereof, and a pinion gear 233' coaxially affixed to or integral with the marker element 400 and thus rotatable therewith about the deployment pivot axis DPA. In this example the marker element 400 is in the form of a disc sector 430, including for example more than 180° of the full disc, and having a perimeter including a circumferential portion 435 and a chord portion 436. The disc sector 430 also has flat faces 439, and disc center which is coaxial with the deployment pivot axis DPA. The gear teeth 231' of the switch member 200 are meshed with pinion gear 233'.

Referring still to FIGS. 7(*a*) and 7(*b*), in condition (B), as the switch member 200 is actuated to pivotably move from the APP to the AEP about activation pivot axis APA (in a counter clockwise direction as seen in these figures), the meshing between gear teeth 231' of the switch member 200 and the pinion gear 233' cause pivoting of the disc sector 430 from the retracted position in housing 20 (FIG. 7(*a*)) to the deployed position outside of the housing 20 via opening 25 (FIG. 7(*b*)) in a pivotable motion about a deployment pivot axis DPA. In the deployed position, the faces 439 are projecting outside of the housing 20 via opening 25 and are clearly visible to an external observer OA outside of the housing 20, who can now be assured that the switch member 200 is in the AEP position, similar to the example of FIGS. 4(*a*) and 4(*b*), mutatis mutandis.

Alternatively, in condition (A), the disc sector 430 is affixed to the pinion gear 233' in a relative angular orientation (for example displaced by 180° from the orientation shown in FIGS. 7(*a*) and 7(*b*)) such that in the APP, the disc sector 430 is in the deployed position, and thus the faces 439 are projecting outside of the housing 20 via opening 25 and are clearly visible to an external observer OA outside of the housing 20, who can now be assured that the switch member 200 is in the APP position.

As the switch member 200 is actuated to pivot from the APP to the AEP about activation pivot axis APA (also in a counter clockwise direction), the meshing between gear teeth 231' of the switch member 200 and the pinion gear 233' cause pivoting of the disc sector 430 from the deployed position outside housing 20 via opening 25 to the retracted position inside of the housing 20 in a pivotable motion about a deployment pivot axis DPA. In the retracted position, the faces 439 are clearly not projecting outside of the housing 20 and this is clearly observable by an external observer OA outside of the housing 20, who can now be assured that the switch member 200 is in the APP position.

Alternatively, in condition (C), the disc sector 430 is in the form of a full disc having two half-disc sectors marked therein, a first disc sector and a second disc sector. The full disc is affixed to the pinion gear 233' in a relative angular orientation such that in the APP, the first disc sector is in the deployed position while the second disc sector is in the retracted position, while in the AEP the first disc sector is in the retracted position while the second disc sector is in the deployed position. Thus, as the switch member 200 is actuated to pivot from the APP to the AEP about activation pivot axis APA, the meshing between gear teeth 231' of the switch member 200 and the pinion gear 233' cause pivoting of the full disc by 180° in which the first disc sector is retracted from the deployed position outside housing 20 to the retracted position inside of the housing 20 via opening 25 in a pivotable motion about a deployment pivot axis DPA, while concurrently the second disc sector is deployed from the retracted position in housing 20 to the deployed position projecting outside of the housing 20 via opening 25 in a pivotable motion about a deployment pivot axis DPA. In the APP position, the corresponding faces of the first disc sector are projecting outside of the housing 20 via opening 25 and this is clearly visible to an external observer OA outside of the housing 20, who is now assured that the switch member 200 is in the AEP position. In the AEP position, the corresponding faces of the second disc sector are projecting outside of the housing 20 via opening 25 and this is clearly visible to an external observer OA outside of the housing 20, who can now be assured that the switch member 200 is in the APP position. To differentiate between the AEP and the APP, the first disc segment in its corresponding deployed position is visually distinguishable from the second disc segment in its corresponding deployed position. For example the first disc segment and the second disc segment can have different colors—for example the first disc segment can have a red color while the second disc segment can have a green color, and/or, the first disc segment and the second disc segment can have different geometrical shapes—for example the first disc segment can have a first geometrical shape while the second disc segment can have a second geometrical shape that is visually very different from the first geometrical shape. For example the first geometric shape can be a full disc segment with continuous faces, while the second geometric shape can include a disc segment having a plurality of through-holes through the faces thereof. Alternatively for example, first geometric shape can be a full disc segment with continuous semi-circular edge, while the second geometric shape can include a disc segment having a star-shaped edge.

In alternative variations of the above examples, and in other examples, the marker element 400, additionally or alternatively, comprises an electromagnetic wave transmitter configured for selectively operating in a transmitting mode or in a non-transmitting mode. In the transmitting mode the electromagnetic wave transmitter selectively transmits electromagnetic waves within a first wavelength range, and in the non-transmitting mode said electromagnetic wave transmitter does not transmit electromagnetic waves within said first wavelength range. For example, the transmitting mode corresponds to the AEP while the non-transmitting mode corresponds to the APP. Alternatively, the transmitting mode corresponds to the APP while the non-transmitting mode corresponds to said AEP.

Alternatively, the marker element 400 comprises an electromagnetic wave transmitter configured for selectively operating in a first transmitting mode or in a second transmitting mode, wherein in the first transmitting mode said electromagnetic wave transmitter selectively transmits electromagnetic waves within a first wavelength range, and wherein in the second transmitting mode said electromagnetic wave transmitter transmits electromagnetic waves within a second first wavelength range different from said first wavelength range. The first transmitting mode can correspond to the AEP while the second transmitting mode corresponds to said APP. Alternatively, the first transmitting mode corresponds to the APP while the second transmitting mode corresponds to said AEP.

For example the first wavelength range and/or the second wavelength range can be in the visible spectrum and/or in the IR or UV ranges.

In the above examples, and in alternative variations thereof and in other examples, and referring again for example to FIGS. 1 and 2, the respective safety device 100 can optionally further comprise a Remove Before Operation (RBO) pin 600 that is initially engaged with the switch member 200 and has to be mechanically disengaged therefrom to enable the safety device 100 to be operated and thus to subsequently allow movement of the switch member 200 from the AEP and the APP, and to allow the S&A device to become armed.

In this example, the RBO pin 600, in the engaged position, is inserted into a hole 690 provided in the switch member 200, mechanically preventing the switch member 200 from moving until the RBO pin 600 is mechanically removed, i.e. disengaged, from the hole 690.

Figure 14:
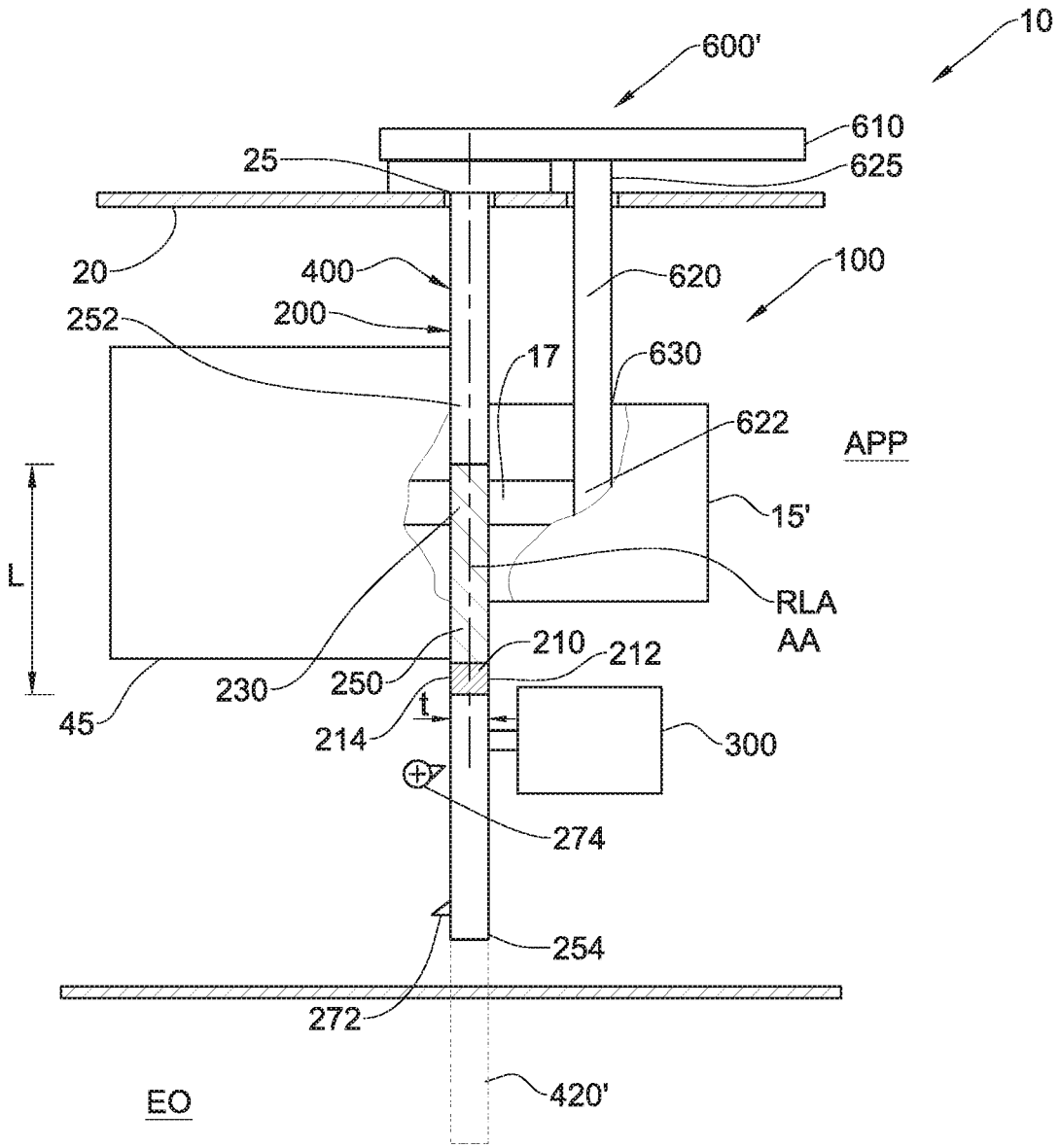
FIG. 14 illustrates in side view a variation of the example of FIG. 1, including an alternative example of the Remove Before Operation pin, in engagement configuration.
Figure 14:
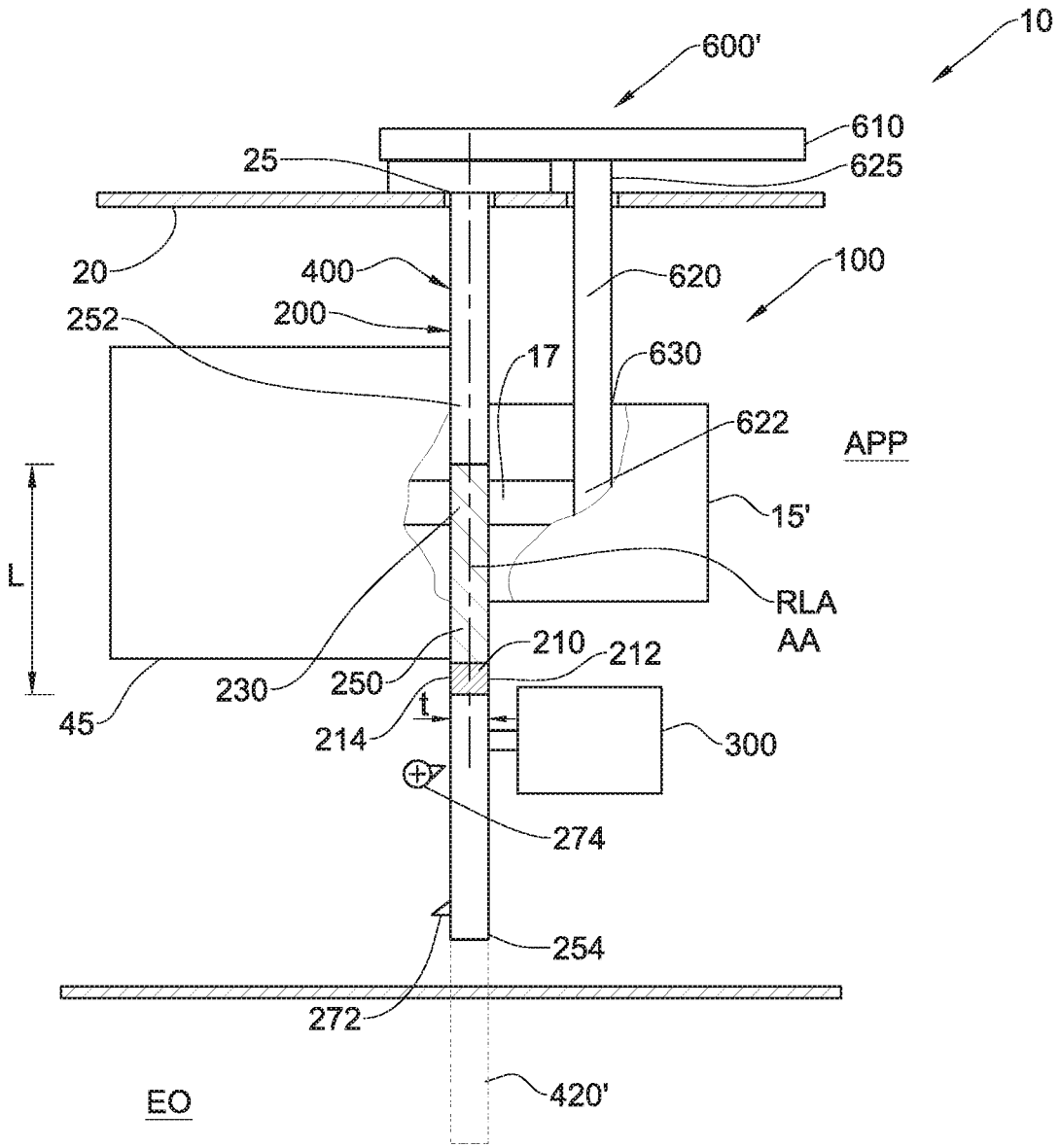
Figure 15:
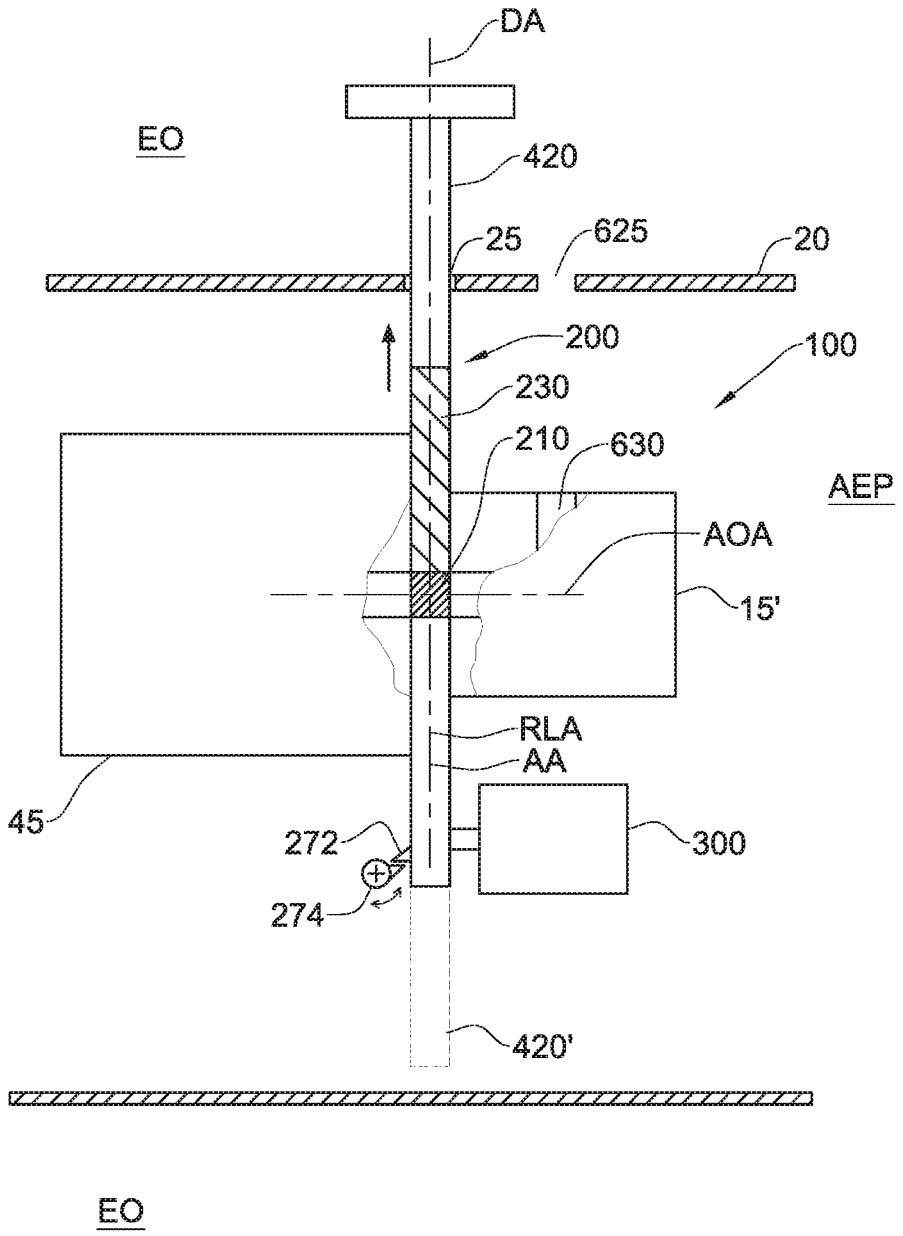
FIG. 15 illustrates in side view the example of FIG. 14, the safety device being in disengagement configuration with respect to the Remove Before Operation pin.

In an alternative variation of the example of FIGS. 1 and 2, and referring to FIGS. 14 and 15, the RBO pin, generally designated with the reference numeral 600', is configured for providing an engaged configuration and a disengaged configuration. In the engaged configuration illustrated in FIG. 14, the RBO pin 600' mechanically prevents the switch member 200 from moving from the APP to the AEP, and also mechanically prevents the S&A device 15' from becoming armed. In this example, the RBO pin 600' comprises a shaft 620 having a first engagement end 622 and a second engagement end 610. The first engagement end 622 is configured for being inserted into a slot 630 provided in the S&A device 15', in the engaged configuration of the RBO pin 600', and mechanically preventing the S&A device 15' from arming when thus engaged. Thus the S&A device 15' in this example is configured in a manner that does not allow itself to become armed when the first engagement end 622 is engaged in the slot 630, and for enabling the S&A device 15' to become armed when the first engagement end 622 is disengaged from the slot 630 (for example as a result of the RBO pin 600' being removed). The second engagement end 610 is in the form of an enlarged head, that overlies the top end 201 of the switch member 200. In the engaged configuration of the RBO pin 600', the enlarged head configuration of the second engagement end 610 abuts and mechanically prevents the top end 201 from moving upwards (as seen in FIG. 14) and thereby prevents the switch member 200 from moving from the APP to the AEP. In the disengaged configuration of the RBO pin 600' (illustrated in FIG. 15) the first engagement end 622 is no longer inserted in the slot 630, allowing the S&A device 15' to become selectively armed, and concurrently the second engagement end 610 is no longer abutting the top end 201, allowing the switch member to be selectively moved from the APP to the AEP.

In at least this example, the RBO pin operates as a Remove Before Fly (RBF) pin, as it is generally removed only prior to flying.

For example, in examples of the presently disclosed subject matter in which the munition is incorporated in a UAV or other carrier vehicle (see example illustrated in FIGS. 8 to 13, for example), the RBO pin 600 is configured such that it is required to be removed from the UAV before flying the UAV, as a safety feature. Thus, so long as the RBO pin 600 is engaged this prevents accidental actuation of the safety device, since disengagement/removal of the RBO pin 600 will eventually allow the munition 10 to become armed.

In other words, the safety device 100 cannot operate or become armed so long as the RBO pin 600 is still engaged.

It is to be noted that the safety device 100 is, in operation, operatively connected to a controller that selectively provides an "attack" command (for example in the form of an electrical or electronic signal or data transfer) to the actuation system 300 under certain conditions. Such an "attack" command can also be provided if it is wished to self-destruct the munition 10, for example. Responsive to receipt of such an "attack" command the actuation system 300 operates to actuate the switch member 200, and thus move the switch member 200 from the APP to the AEP. Such an "attack" command is provided by the controller, when the target is located and the munition 10 is finally committed to neutralize the target, for example. This can occur, for example, at or within the last period of flight to target, or if commanded to self-destruct. Operation of the controller to provide such an "attack" command can be manual (for example sent to the controller in the form of a radio signal or data transfer), or can be autonomously programmed in the controller; alternatively the controller can be programmed in any other suitable manner to operate the safety device 100.

Until such an "attack" command is provided, the safety device 100 is in arming prevention mode, and allows the munition to be recovered safely, in case a mission is aborted, for example, even if the S&A becomes armed inadvertently for example due to a single point failure, since the safety device 100 operates to provide an additional barrier that prevents the S&A feature from detonating the munition. Furthermore, according to some aspects of the presently disclosed subject matter the marker element can provide a reliable visual indication of the safety state of the safety device 100, i.e., indicating that the safety device 100 is in arming prevention mode and/or that the safety device 100 is in arming enabling mode.

Such an "attack" command can also activate the S&A device 15 to the respective arm mode, or alternatively the S&A device 15 can be armed using a different signal.

Figure 16B:
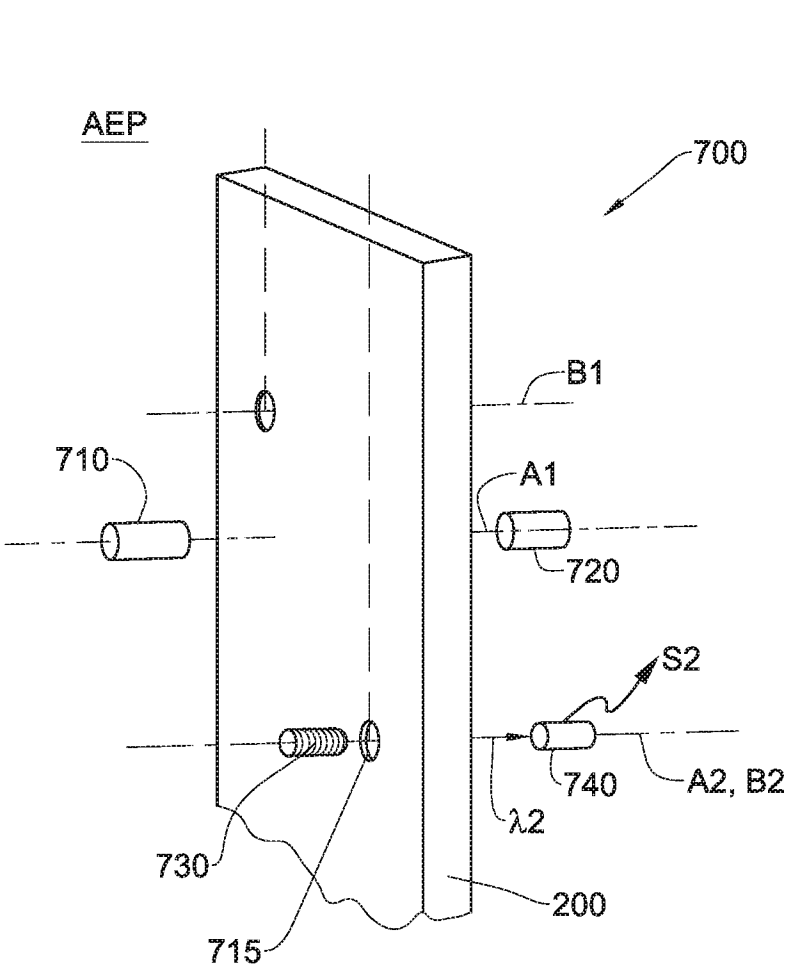
FIGS. 16(*a*) and 16(*b*) illustrate, in partial isometric view, a positional sensor system for the switch member of the examples of FIGS. 1 to 15, in in arming prevention mode and in arming enabling mode respectively.
Figure 16A:
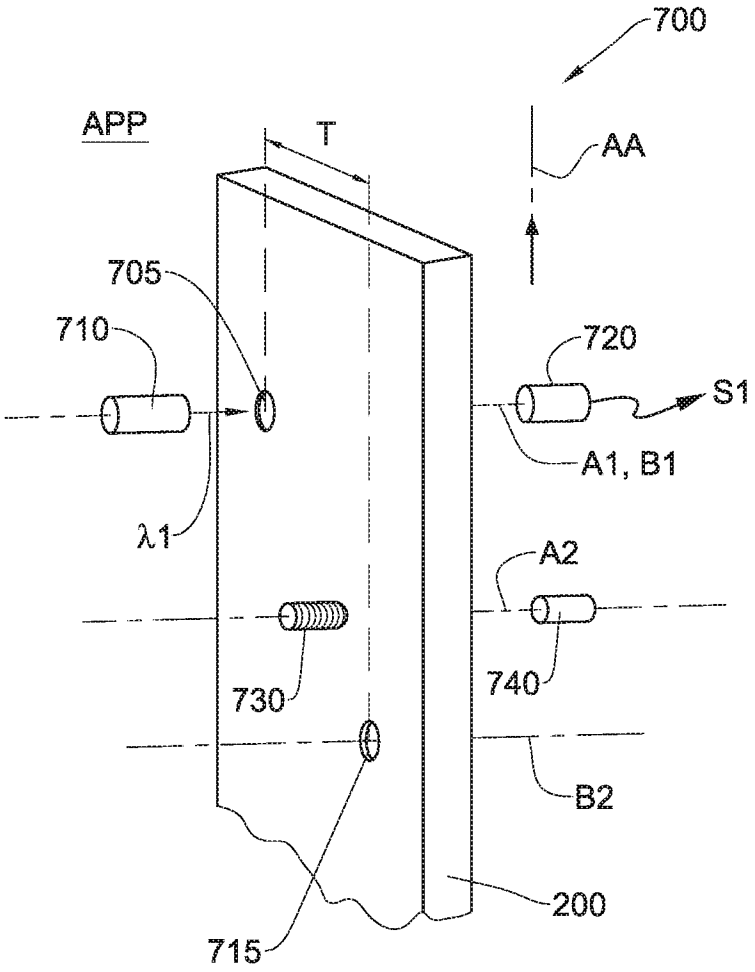

Referring to FIGS. 16(*a*) and 16(*b*), the marker element 400 according to any one of the above examples can include, or alternatively be in the form of, a positional sensor system 700 set up with respect to the switch member 200.

The positional sensor system 700 comprises a first emitter sensor set, comprising a first LED emitter 710 and a first LED sensor 720, aligned along an axis A1. In operation, the first LED emitter 710 transmits light of a particular wavelength λ1 on a path along axis A1 towards the first LED sensor 720, and in the absence of an opaque object blocking this path, the first LED sensor 720 detects the transmitted light and provides a corresponding signal S1. This signal S1 can be, for example, in the form of a light (UV, infrared and/or visible light spectrum) being lit on the outside of the munition, and/or in the form of an audible sound, and/or in the form of a radio transmission. Conversely, in operation of the first emitter sensor set, if an opaque object blocks this path, the first LED sensor 720 cannot detect the transmitted light from the first LED emitter 710 and does not provide the aforementioned corresponding signal S1. In this example, the switch member 200 is made from an opaque material, and includes a hole 705 through the thickness thereof along an axis B1. Axes A1 and B1 are generally orthogonal to activation axis AA. While in this example axes A1 and B1 are parallel, they can instead be inclined with one another at a small angle, depending on the size of hole 705 and the spacing between the first LED emitter 710 and the first LED sensor 720. The first LED emitter 710 and the first LED sensor 720 are positioned on either sides of the switch member 200, such that when the switch member 200 is in the APP the axes A1 and B1 are aligned and coaxial. This enables the first LED sensor 720 to detect the light transmitted by first LED emitter 710 thereto via the hole 705. In alternative variations of this example in which axes A1 and B1 are not parallel, the first LED emitter 710 and the first LED sensor 720 are positioned on either side of the switch member 200, such that when the switch member 200 is in the APP the axes A1 and B1 intersect within the hole 705 or in close proximity thereto such as to allow the first LED sensor 720 to detect the light transmitted by first LED emitter 710 thereto via the hole 705. In any case, as the switch member 200 is moved to the AEP along activation axis AA, the hole 705 (and axis B1) goes out of alignment with axis A1, and the opaque material of the switch member 200 thus blocks the first LED sensor 720 from detecting the light transmitted by the first LED emitter 710. The first emitter sensor set can thus provide a positive indication that the switch member 200 is in the APP, via the aforesaid signal S1, and the absence of the aforementioned signal S1 can be taken as an indication that the switch member 200 is not in the APP.

In alternative variations of this example, the first emitter sensor set is configured to conversely provide the aforesaid signal S1 only when first LED sensor 720 cannot detect the transmitted light from the first LED emitter 710, and not to provide the aforesaid signal S1 when first LED sensor 720 detects the transmitted light from the first LED emitter 710 via hole 705. In such a case, first emitter sensor set can thus provide a positive indication that the switch member 200 is not in the APP, via the aforesaid signal S1, and the absence of the aforementioned signal S1 can be taken as an indication that the switch member 200 can be in the APP.

The positional sensor system 700 further comprises a second emitter sensor set, comprising a second LED emitter 730 and a second LED sensor 740, aligned along an axis A2. In operation, the second LED emitter 730 transmits light of a particular wavelength λ2 on a path along axis A2 towards the second LED sensor 740, and in the absence of an opaque object blocking this path, the second LED sensor 740 detects the transmitted light and provides a corresponding signal S2. This signal S2 can be, for example, in the form of a light (UV, infrared and/or visible light spectrum) being lit on the outside of the munition, and/or in the form of an audible sound, and/or in the form of a radio transmission. Conversely, in operation of the second emitter sensor set, if an opaque object blocks this path, the second LED sensor 740 cannot detect the transmitted light from the second LED emitter 730 and does not provide the aforementioned corresponding signal S2. In this example, the switch member 200 is made from an opaque material, and includes a hole 715 through the thickness thereof along an axis B2. Axes A2 and B2 are generally orthogonal to activation axis AA. While in this example axes A2 and B2 are parallel, they can instead be inclined with one another at a small angle, depending on the size of hole 715 and the spacing between the second LED emitter 730 and the second LED sensor 740. The second LED emitter 730 and the second LED sensor 740 are positioned on either sides of the switch member 200, such that when the switch member 200 is in the AEP the axes A2 and B2 are aligned and coaxial. This enables the second LED sensor 740 to detect the light transmitted by second LED emitter 730 thereto via the hole 715. In alternative variations of this example in which axes A2 and B2 are not parallel, the second LED emitter 730 and the second LED sensor 740 are positioned on either side of the switch member 200, such that when the switch member 200 is in the AEP the axes A2 and B2 intersect within the hole 715 or in close proximity thereto such as to allow the second LED sensor 740 to detect the light transmitted by second LED emitter 730 thereto via the hole 715. In any case, when the switch member 200 is at the APP the axes A2 and B2 are not in alignment, and the opaque material of the switch member 200 thus blocks the second LED sensor 740 from detecting the light transmitted by the second LED emitter 730. As the switch member 200 is moved from the APP to the AEP along activation axis AA, the hole 715 (and axis B2) comes into alignment with axis A2, allowing the second LED sensor 740 to detect, via hole 715, the light transmitted by the second LED emitter 730. The second emitter sensor set can thus provide a positive indication that the switch member 200 is in the AEP, via the aforesaid signal S2, and the absence of the aforementioned signal S2 can be taken as an indication that the switch member 200 is not in the AEP.

In alternative variations of this example, the second emitter sensor set is configured to conversely provide the aforesaid signal S2 only when second LED sensor 740 cannot detect the transmitted light from the second LED emitter 730, and not to provide the aforesaid signal S2 when second LED sensor 740 detects the transmitted light from the second LED emitter 730 via hole 715. In such a case, second emitter sensor set can thus provide a positive indication that the switch member 200 is not in the AEP, via the aforesaid signal S2, and the absence of the aforementioned signal S2 can be taken as an indication that the switch member 200 can be in the AEP.

It is to be noted that holes 705 and 715 are transversely spaced by a spacing T (FIG. 16(*a*)).

While the wavelengths λ2 and λ1 can be the same or different from one another.

The signals S1 and S2 can be in the same form, in similar forms, or in different forms from one another. For example, signals S1 and S2 can be observed as lights of different colors, or lights of the same color but blinking at significantly different frequencies, or one of the signals S1 and S2 can be in the form of a light while the other is in the form of an audible sound, and so on.

In alternative variations of this example, the safety device 100 can omit the positional sensor system 700 entirely, or the safety device can include the first emitter sensor set but omit the second emitter sensor set, or the safety device can include the second emitter sensor set but omit the first emitter sensor set.

In these or other alternative variations of this example the positional sensor system can be set up with respect to the marker element rather than with respect to the switch member.

In these or other alternative variations of this example the positional sensor system can be based on other technologies rather than light transmission/detection, in particular LED transmission/detection.

According to another aspect of the presently disclosed subject matter, and referring to FIGS. 8 to 13, an example of implementation of a safety device in a munition is illustrated, in which the munition is in the form of a warhead module 800 accommodated in a carrier vehicle.

Figure 8:
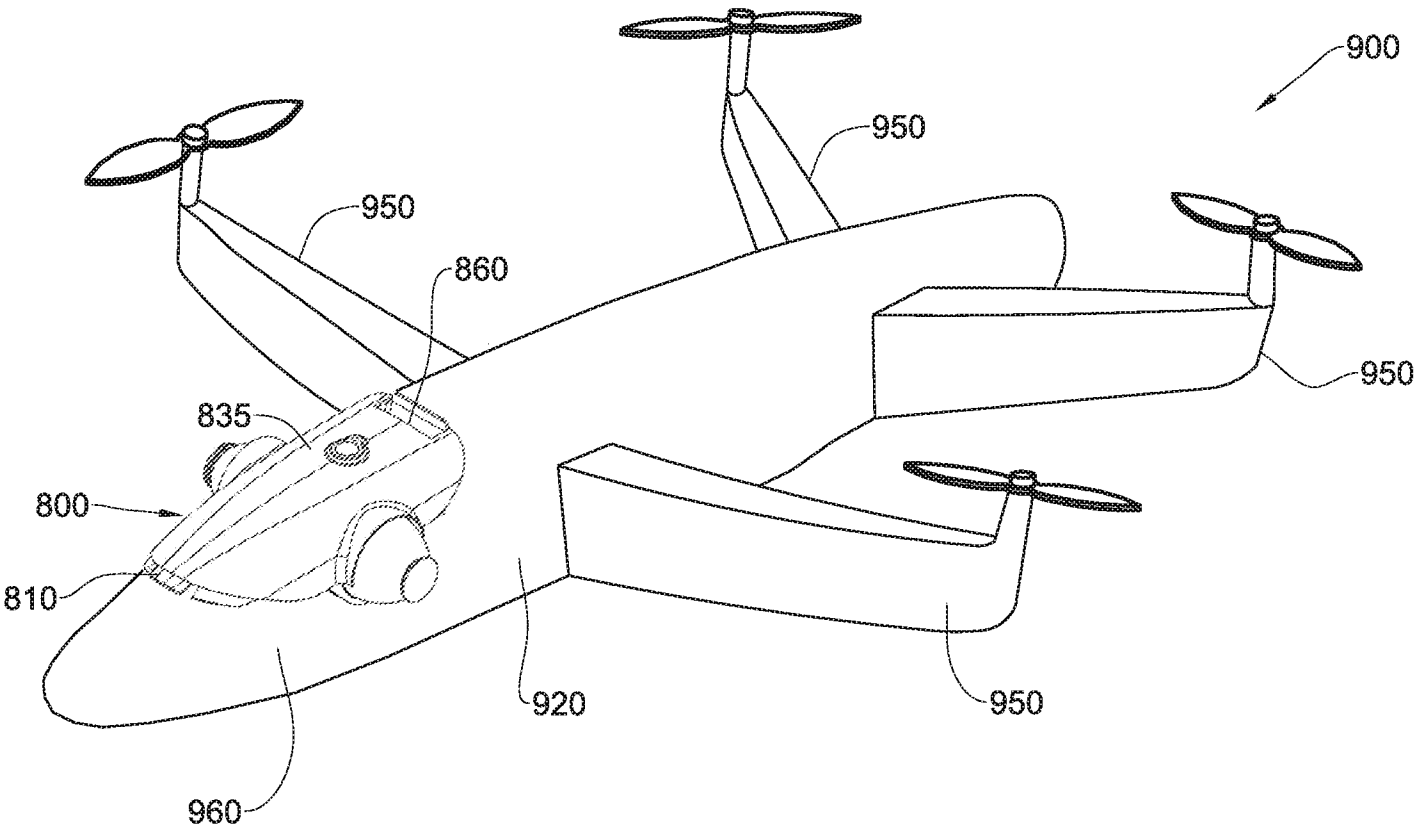
FIG. 8 illustrates in isometric view, an air vehicle including warhead module according to an example of the presently disclosed subject matter.

In this example, ad referring in particular to FIG. 8, the carrier vehicle is an air vehicle, and in particular a UAV, generally designated with the numeral 900. Furthermore while in this example, the UAV is in the form of a quadcopter, in alternative variations of this example the carrier vehicle can instead be a terrain vehicle, or a seaborne (sea surface and/or submersible) vehicle, or an amphibious vehicle, or a hybrid vehicle, or the carrier vehicle can be a fixed wing air vehicle or a different type of rotor wing air vehicle, or the carrier vehicle can be configured as a rocket, or as a missile, or as a bomb or as other free-fall weapons.

Referring again to FIG. 8, the UAV 900 comprises an arrangement of four rotors 950 that provide the UAV with maneuverability in six degrees of freedom, as well as hover capability. The UAV 900 further comprises a fuselage 920, which accommodates a controller, electric power source (for example batteries), a communication module and/or a navigation module, and a payload portion 960. The payload portion is configured for enabling the warhead module 800 to be accommodated in the UAV 900.

Figure 9A:
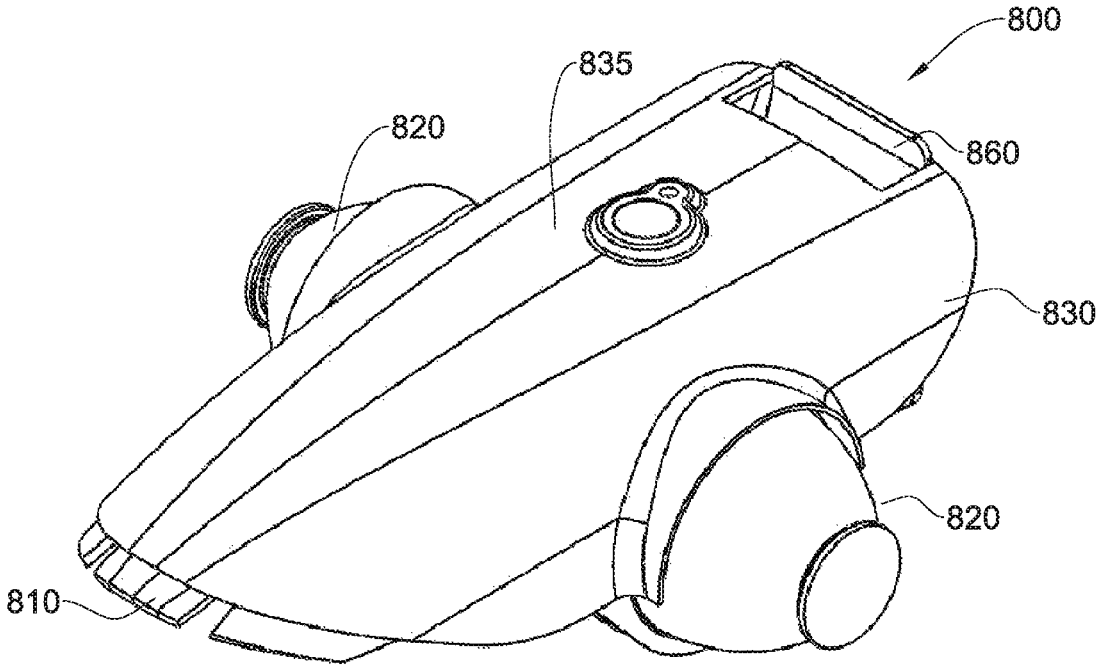
FIG. 9(*a*) illustrates in isometric view the warhead module example of FIG. 8, the safety device thereof being in arming prevention mode.
Figure 9B:
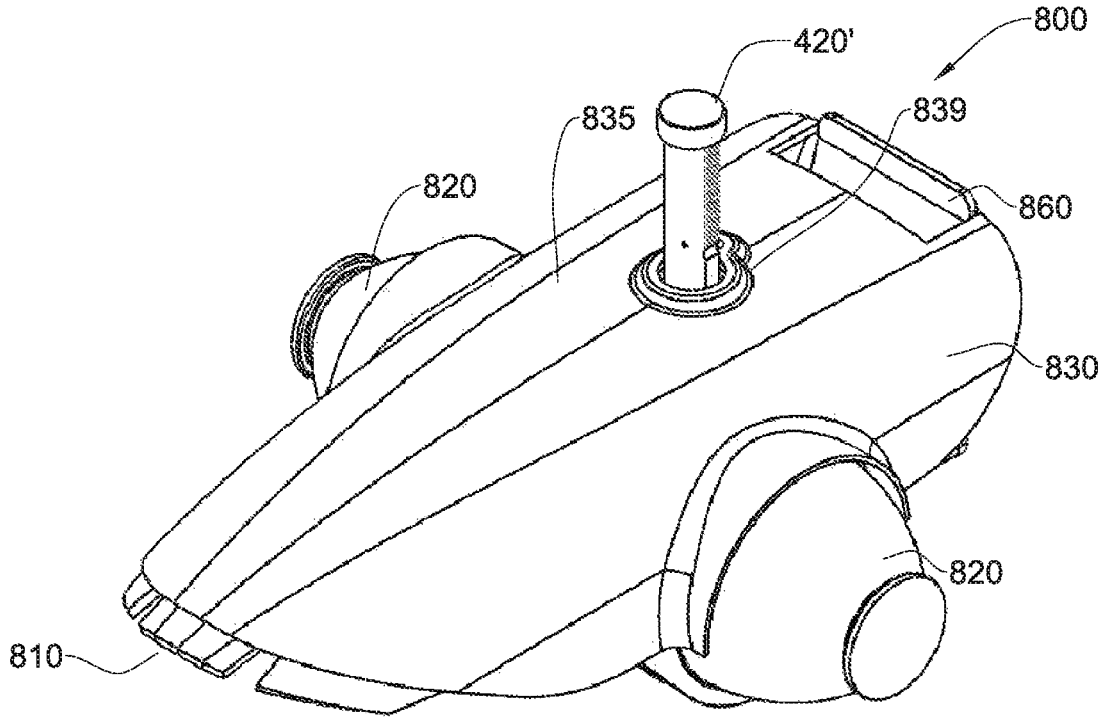
Figure 11A:
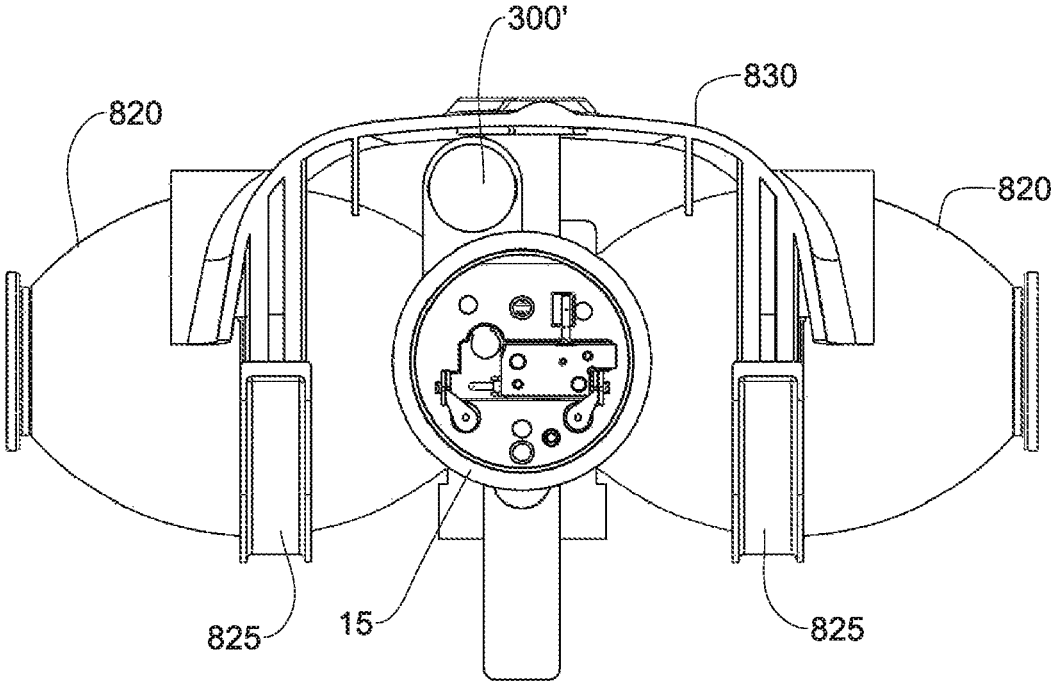
FIG. 11(*a*) illustrates in aft view the warhead module example of FIG. 8, the safety device thereof being in arming prevention mode.
Figure 11B:
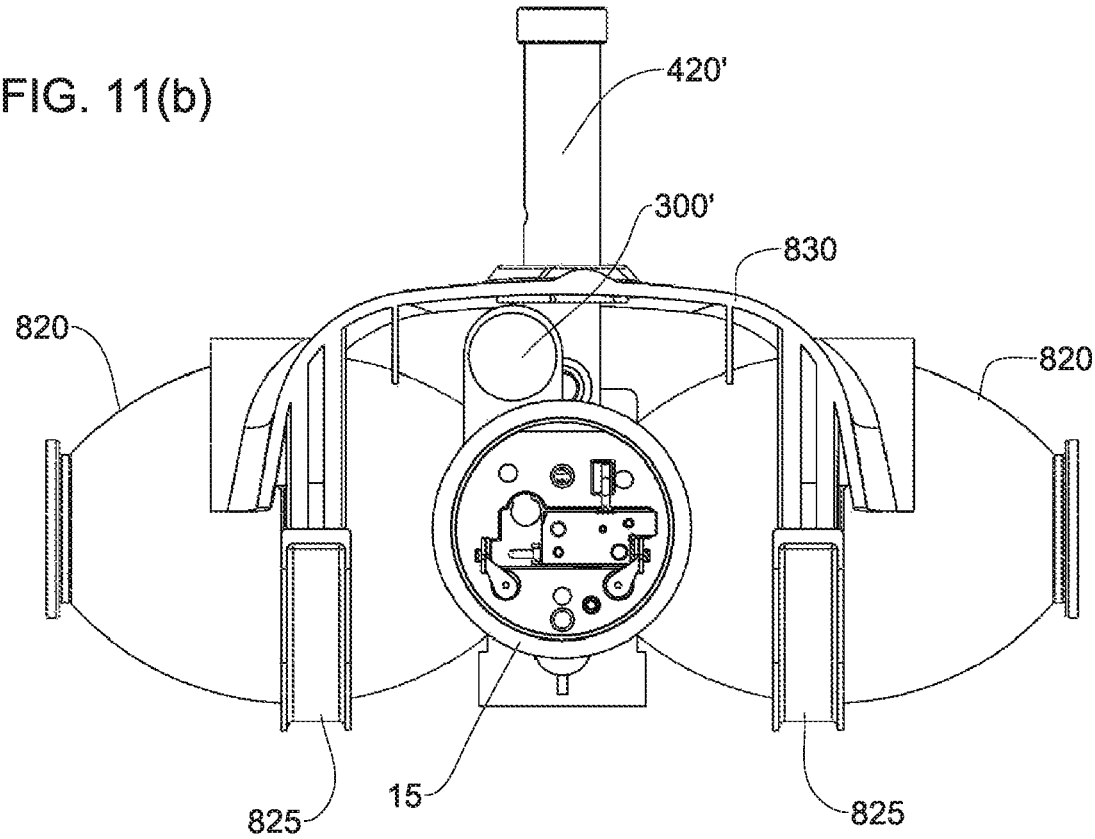
Figure 12:
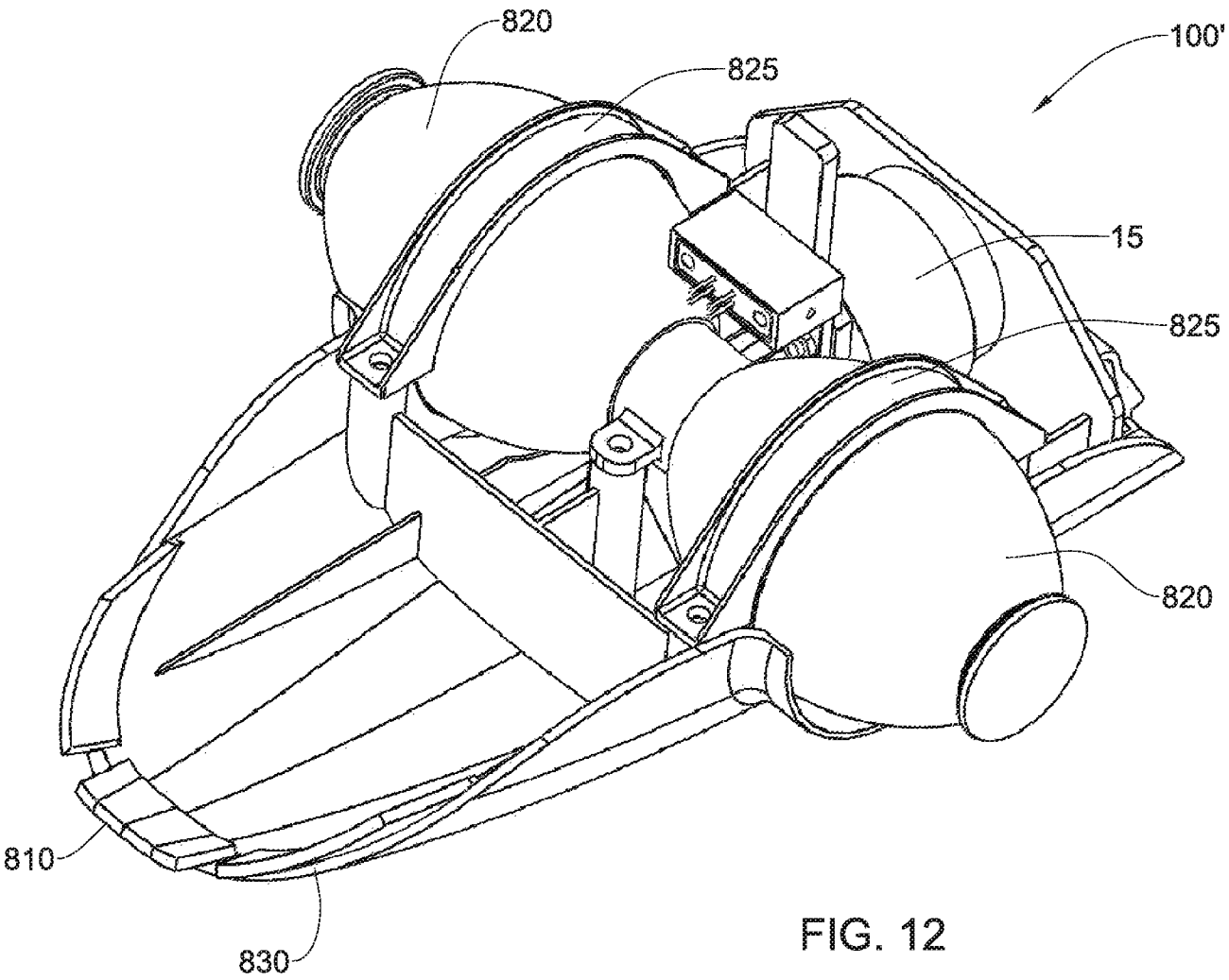
FIG. 12 illustrates in bottom isometric view the warhead module example of FIG. 8.

In this example, and referring also to FIGS. 9(*a*) to 13, the warhead module 800 comprises a munition in the form of a warhead comprising two hand grenades 820 immovably affixed to a casing portion 830 via retaining rings 825 (FIGS. 11(*a*), 11(*b*), 12). In alternative variations of this example, munition in the form of a warhead can include only one grenade, or more than two grenades, or indeed another type of explosive or other ordinance.

The casing portion 830 corresponds to housing 20 or part thereof of the above examples relating to FIGS. 1 to 7(*b*), mutatis mutandis, and in this example the casing portion 830 forms part of the fuselage 920 when the warhead module 800 is operatively engaged to the UAV 900, for example via lip 810 and latch arrangement 860. The casing portion 830 has an externally exposed surface 835 that is externally visible by an external observer EO when the warhead module 800 is operatively engaged to the UAV 900 as in FIG. 8. The casing portion 830 comprises a through-opening 839 through the casing thickness, and corresponds to opening 25 of the above examples relating to FIGS. 1 to 7(*b*), mutatis mutandis.

Figure 13:
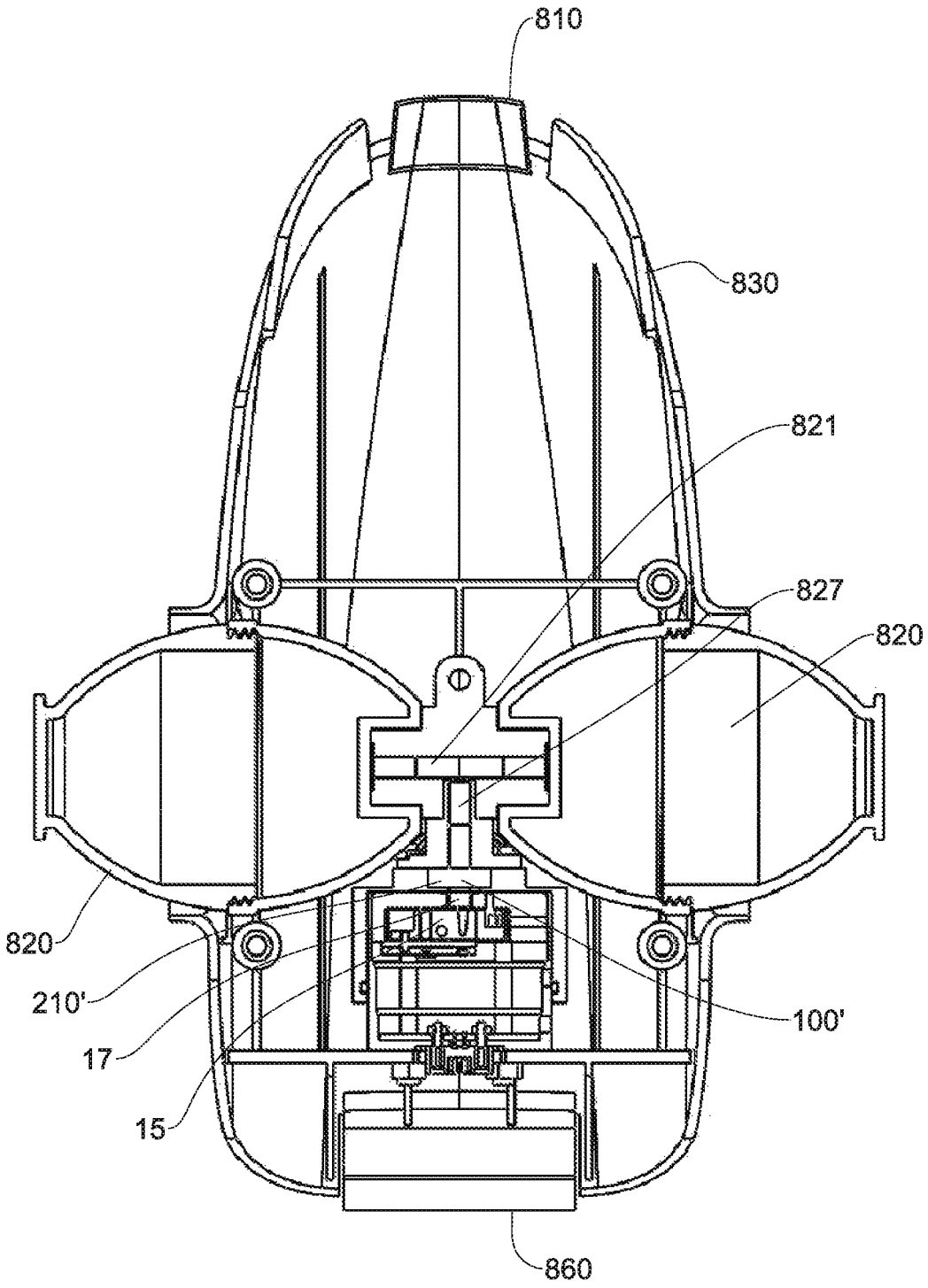
FIG. 13 illustrates in bottom cross-sectional view the warhead module example of FIG. 8.

Referring in particular to FIG. 13, the two grenades 820 are in mutual arming communication via common lead 821, which is arming communication with input lead 827, such that common lead 821 and input lead 827 are in a "T" configuration.

The warhead module 800 comprises S&A device 15 (as disclosed herein relating to the above examples relating to FIGS. 1 to 7(*b*), mutatis mutandis), and further comprises a safety device 100', which corresponds to safety device 100 of the above examples relating to FIGS. 1 to 7(*b*), mutatis mutandis.

Thus, safety device 100' comprises switch member 200', marker element 400', actuation mechanism 300', corresponding to switch member 200, marker element 400, actuation mechanism 300, respectively of the above examples relating to FIGS. 1 to 7(*b*), mutatis mutandis.

In this example, the safety device 100' is configured for providing condition (B), i.e., when the switch member 200' is in the AEP the marker element 400' is externally observable, i.e. under conditions in which the S&A device 15 can potentially arm the munition explosives, which in this example comprise the two grenades 820. Thus, in the illustrated example, the safety device 100' corresponds to the safety device 100 of the example illustrated in FIGS. 1 and 2, mutatis mutandis, though it is clear that the safety device 100' can instead correspond to the safety device 100 of any of the other examples illustrated in FIGS. 3(*a*) to 7(*b*), mutatis mutandis.

In this example the switch member 200' is the form of an elongate rod 250' (also referred to herein as a slider), and comprises a transfer lead portion 210' longitudinally spaced from a blocking portion 230' along the rod longitudinal axis, corresponding to transfer lead portion 210 and the blocking portion 230, respectively of the above examples relating to FIGS. 1 and 2, mutatis mutandis. The rod 250' has a substantially uniform transverse thickness and is contiguous with marker element 400', also in the form of a rod member 420' (corresponding to rod member 420 of the above examples relating to FIGS. 1 and 2, mutatis mutandis) and is affixed thereto or formed integrally therewith. To enhance visibility, rod member 420 is colored in red, but can instead be colored in a different color and/or exhibit other optical properties, such as for example fluorescence and/or reflectivity and/or can include a light source (for example in the UV wavelength range and/or the visible spectrum and/or the IR wavelength range) that is lit when in the AEP or in the APP.

In the APP, the marker element 400', in the form of a rod member 420', is completely retracted within the fuselage 920, as best seen in FIGS. 8, 9(*a*), 10(*a*), 11(*a*), and the blocking portion 230' blocks arming contact with, and thereby prevent arming communication between, the munition explosive (in the form of the two grenades 820) and the S&A device 15.

Thus if an external observer EO observes that the rod member 420' is not projecting outside the fuselage, this is an indication that the safety device 100' is in arming prevention mode, and thus the UAV 900 can be approached. Such an indication can be, at least in some examples of the presently disclosed subject matter, to have a very high degree of reliability, for example such as to be considered in practical terms to be an absolute indication that the safety device 100' is in arming prevention mode.

Figure 10A:
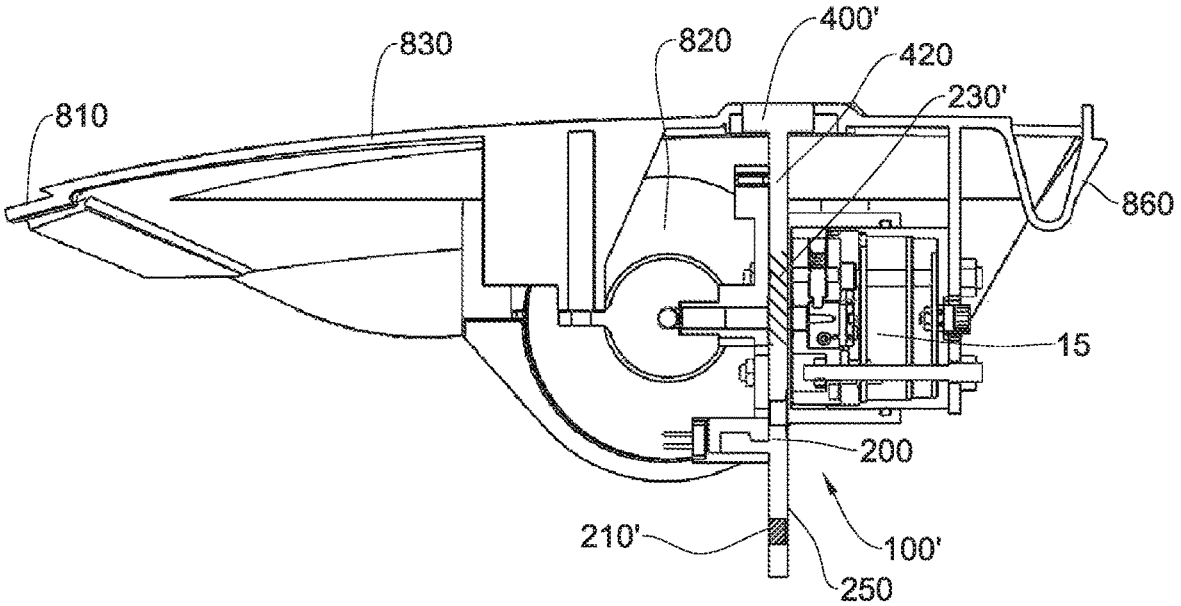
FIG. 10(*a*) illustrates in cross-sectional side view the warhead module example of FIG. 8, the safety device thereof being in arming prevention mode.
Figure 10B:
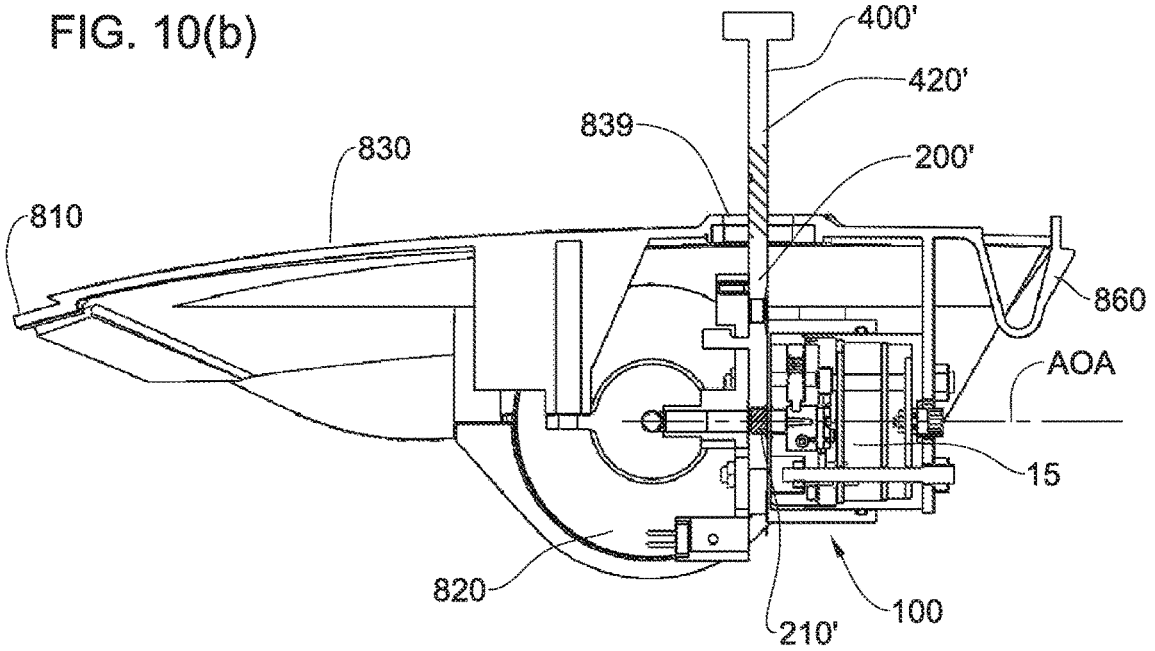

In the AEP, the marker element 400', in the form of a rod member 420', is deployed with respect to the fuselage 920, as best seen in FIGS. 9(*b*), 10(*b*), 11(*b*), and the rod member 420' visibly projects outside of the fuselage, and in particular outside of the casing portion 830. In at least one example, the rod member 420' visibly projects about 32 mm or 40 mm outside of the fuselage, in particular the rod member 420' visibly projects about 32 mm or 40 mm outside of the casing portion 830. In the AEP, the transfer lead portion 210' enables arming contact with, and thereby allows arming communication between, the munition explosive (in the form of the two grenades 820) and the S&A device 15. In the AEP, the input lead 827, the transfer lead portion 210' and the S&A device 15 are in-line, along axis of arming AOA, as best seen in FIGS. 10(*b*) and 13. Thus, should the S&A device 15 arm, this would result in the grenades 820 detonating.

Thus if an external observer EO observes that the rod member 420' is actually projecting outside the fuselage, this is an indication that the safety device 100' is in arming enabling mode, and thus the UAV should not be approached, except perhaps, for example, by trained personnel, as it can present a safety hazard.

Thus, the safety device 100' provides a visual indication to an external observer EO of whether the safety device 100' is in armed mode or arming prevention mode, and thus allows safe recovery of the UAV after the mission starts, but before the "attack" command is issued. The safety device 100' thus allows an external observer to determine with a high degree of certainty that the UAV is safe to return home and be handled in case a mission is aborted. Such a high degree of certainty can be, at least in some examples of the presently disclosed subject matter, a very high degree of certainty, for example such as to be considered in practical terms to be an absolute high degree of certainty, for example nominally 100% degree of certainty or close thereto.

In other words, the safety device 100' provides an additional barrier that prevents the S&A device from detonating the munition, even if the S&A device becomes armed inadvertently for example due to a single point failure.

In operation, the UAV 900 is made ready for a mission by engaging the warhead module 800 thereto, and the corresponding RBO pin (not shown in these figures) is removed just prior to initiation of flight of the UAV.

The UAV 900 is flown to target. This can be done autonomously, for example the on-board computer (i.e., the controller) navigating to a geographical location using the navigation module, and/or the UAV 900 can home on to the target using seeker devices, or indeed other devices for navigation and/or target homing (for example including GPS devices for navigation and/or optical recognition devices for identifying and locking onto a target) installed in the UAV 900. Alternatively, the UAV is flown by ground personnel (remote pilot) to the target, providing flight commands via communications link and/or data link, and such commands are received by the communications module and processed by the on-board computer (i.e., the controller).

Once the target is located (for example at or within the last period of flight to target) the "attack" command is communicated to the controller, which then activates the actuator 300' to slide the rod 250' and rod member 420' concurrently to the AEP from the APP, and can also activate the S&A device 15 to arm mode.

At this point the input lead 827, the transfer lead portion 210' and the output lead 17 of S&A device 15 are in-line, along axis of arming AOA. The warhead, in this example in the form of the two grenades 820, can then be detonated according to predetermined criteria, for example when hitting the target or at predetermined distance therefrom or via operator command, and the detonator in the S&A device 15 provides a detonation wave that travels to the input lead 827, via the transfer lead portion 210', and then to the two grenades 820 via common lead 821.

On the other hand, if the mission is aborted for example prior to the attack command having been communicated to the UAV 900, the UAV can be returned home, and at that point ground personal can easily observe from a distance whether or not the rod member 420' is actually projecting outside the fuselage. If it does not project, this provides in this example an indication that the safety device 100' was not armed, and thus that it is safe to approach the UAV, even if the S&A device 15 became armed; on the other hand if rod member 420' is observed as actually projecting outside the fuselage, this provides an indication that the safety device 100 is armed, and thus the UAV presents a potentially hazardous threat and should not be approached as a safety measure. Whether or not the UAV is an actual threat will of course depend on whether or not the S&A device 15 is also armed.

It is also to be noted that the safety device 100' is also useful in recovering a UAV in other scenarios, for example where it is not known whether or not the attack signal was communicated to the UAV. Such a scenario can occur, for example, where such an attack signal is to be provided by ground forces remote from the UAV pilot.

Operation of a UAV fitted with the safety device according to the other examples thereof disclosed herein is similar to the operation disclosed above, with the appropriate differences corresponding to whether the safety device is configured for providing condition (A), or (C), mutatis mutandis. Thus for example if the safety device is configured for providing condition (A), then the corresponding marker element 400 would be visible to an external observer only when the safety device is in arming prevention mode.

Figure 17A:
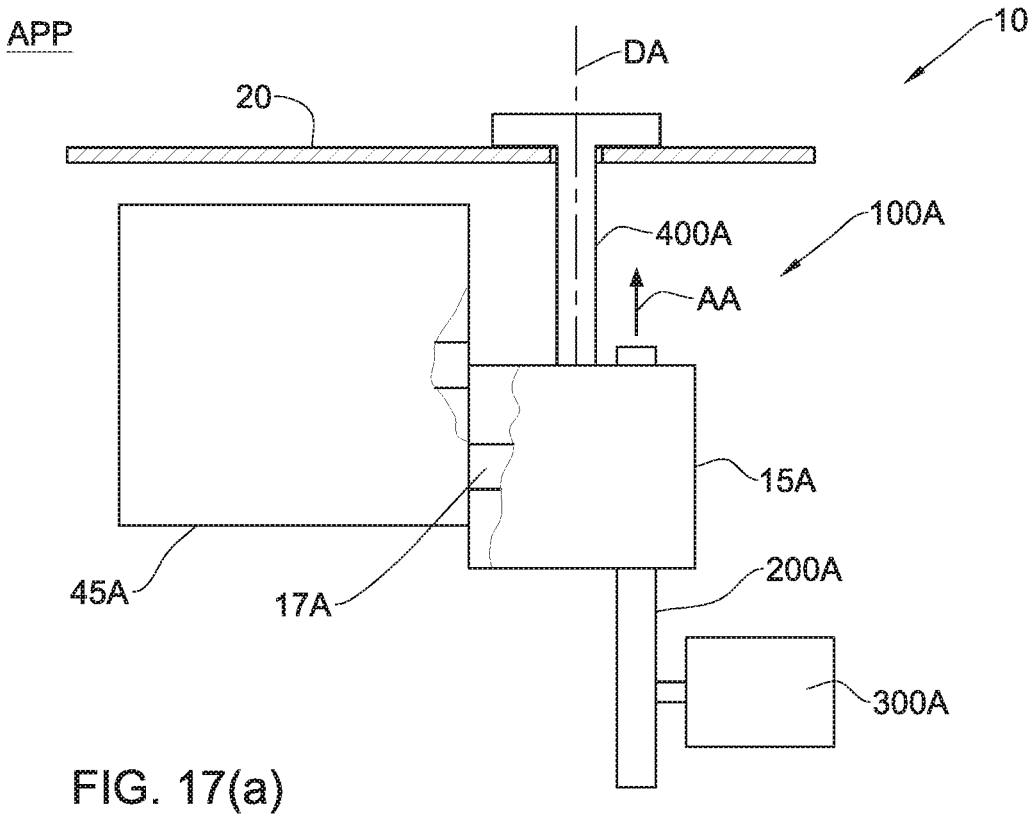
FIG. 17(*a*) illustrates in side view a munition including a safety device according to a second example of the presently disclosed subject matter, the safety device being in arming prevention mode.
Figure 17B:
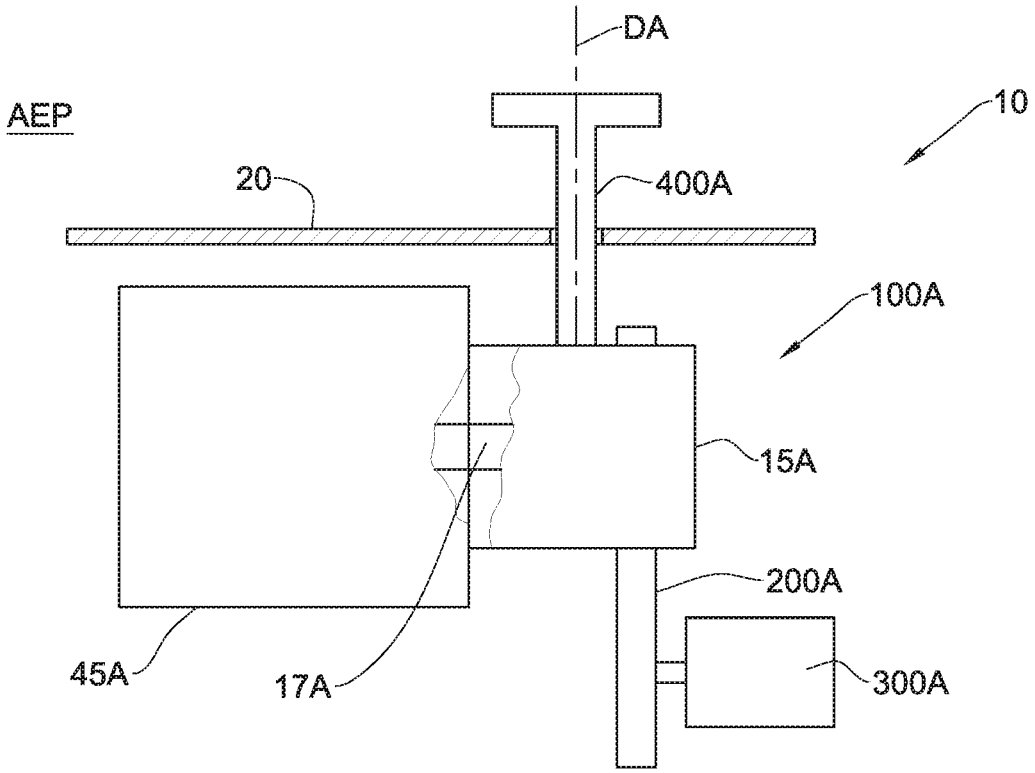

Referring to FIGS. 17(*a*) and 17(*b*), a safety device for a munition 10 according to a second example of the presently disclosed subject matter, generally designated 100A, comprises a switch member 200A, an actuation mechanism 300A, a S&A device 15A, respectively similar to the safety device 100, switch member 200 actuation mechanism 300 and S&A device 15, as disclosed above regarding the first example and alternative variations thereof, mutatis mutandis, with some differences as will become clearer herein. In the second example, the S&A device 15A is not fixedly mounted with respect to the munition 10, and in particular with respect to the munitions explosives 45. Rather, the S&A device 15A is movably mounted with respect to the munition 10. In particular, the switch member 200A, while also movable between at least two positions including the APP and the AEP, is configured for enabling the S&A device 15A thereto, thereby carrying and concurrently moving the S&A device 15A between the APP and AEP. As such, the switch member 200A is not required to be positioned between the S&A device 15A and the explosives 45A, nor does the switch member 200A require the blocking portion 230 or the transfer lead portion 210 as in the first example.

Thus, referring to FIG. 17(*a*), when the switch member 200A is in the APP, the S&A output lead 17A (corresponding to the aforesaid S&A output lead 17) is out of alignment with the munition explosive 45A, thereby effectively blocking arming communication between the munition explosive 45A and the S&A device 15A. Thus detonation of the explosives 45A is not permitted, even if the S&A device 15A is armed.

Referring to FIG. 17(*b*), as the switch member 200A is moved to the AEP, the S&A output lead 17A comes into alignment with the munition explosive 45A, thereby allowing direct arming communication between the munition explosive 45A and the S&A device 15A. Thus detonation of the explosives 45A is now possible, if the S&A device 15A is armed.

In this example, the safety device 100A also includes a marker element 400A, similar to the marker element 400 as disclosed herein with respect to the first example and alternative variations thereof, mutatis mutandis. As with the first example, mutatis mutandis, in general, the marker element 400 can be configured to enable the external observer to be alerted to any one of conditions (A), (B) or (C) as discussed above regarding the first example, mutatis mutandis. Thus, for example, in the APP the marker element 400A does not project from the munition 10, while in the AEP the marker element does project away from the munition 10, thereby alerting an external observer that the safety device is in the AEP.

In this example, the switch member 200A moves the S&A device 15A linearly between the APP and the AEP. However, in alternative variations of the second example, the switch member 200A can instead move the S&A device 15A in a rotary manner between the APP and the AEP In the method claims that follow, alphanumeric characters and Roman numerals used to designate claim steps are provided for convenience only and do not imply any particular order of performing the steps.

Finally, it should be noted that the word "comprising" as used throughout the appended claims is to be interpreted to mean "including but not limited to".

While there has been shown and disclosed examples in accordance with the presently disclosed subject matter, it will be appreciated that many changes can be made therein without departing from the spirit of the presently disclosed subject matter.

The invention claimed is:

1. A safety device for use with a munition, the munition including a munition explosive and a safe and arm (S&A) device for activation of the munition explosive, the safety device comprising:

a switch member, configured for being disposed between the munition explosive and the S&A device, said switch member being movable between at least two switch positions including:

a first switch position, being an arming prevention position (APP), in which arming communication between the munition explosive and the S&A device is prevented; and a second switch position, being an arming enabling position (AEP), in which arming communication between the munition explosive and the S&A device is allowed; and an actuation mechanism for selectively moving said switch member at least from said APP to said AEP to thereby enable the S&A device, when armed, to detonate the munition explosive via the switch member;

said switch member comprising a marker element, wherein the marker element is configured for providing an externally observable indication corresponding to the switch member being in at least one of said switch positions; and wherein said marker element comprises a rod member that is deployable from a retracted position, in which the rod member is not externally observable, and a deployed position, in which the rod member is externally observable; and a lock mechanism for reversibly or irreversibly locking the switch member at said AEP after the switch member has moved from the APP.

2. The safety device according to claim 1, wherein in the retracted position the rod member is enclosed in a housing and thereby not externally observable, while in the deployed position the rod member projects outside of the housing via an opening and is thereby externally observable.

3. The safety device according to claim 1, wherein said switch member comprises:

a transfer lead portion, configured to be in arming contact with, and thereby providing arming communication between, the munition explosive and the S&A device when said switch member is at said AEP; and a blocking portion, configured to block arming contact with, and thereby prevent arming communication between, the munition explosive and the S&A device when said switch member is at said APP.

4. The safety device according to claim 1, including one of the following:

wherein said switch member is moved from said APP to said AEP in linear motion along an activation axis;

wherein said switch member is moved from said APP to said AEP in linear motion along an activation axis, and, wherein said switch member is in the form of a elongate rod having a rod longitudinal axis, wherein said transfer lead portion is longitudinally spaced from said blocking portion along said rod longitudinal axis;

wherein said switch member is moved from said APP to said AEP in linear motion along an activation axis, and, wherein said switch member is in the form of a elongate rod having a rod longitudinal axis, wherein said transfer lead portion is longitudinally spaced from said blocking portion along said rod longitudinal axis, and, wherein said rod longitudinal axis is parallel to said activation axis;

wherein said switch member is moved from said APP to said AEP in pivoting motion about a pivot axis;

wherein said switch member is moved from said APP to said AEP in pivoting motion about a pivot axis, and, wherein said switch member is in the form of a plate having a plate pivoting axis, wherein said transfer lead portion is circumferentially spaced from said blocking portion with respect to said plate pivoting axis; or wherein said switch member is moved from said APP to said AEP in pivoting motion about a pivot axis, and, wherein said switch member is in the form of a plate having a plate pivoting axis, wherein said transfer lead portion is circumferentially spaced from said blocking portion with respect to said plate pivoting axis, and, wherein said plate pivoting axis is coaxial with said pivot axis.

5. The safety device according to claim 1, wherein the safety device is independent/different from the S&A device.

6. The safety device according to claim 1, wherein the marker element is configured for providing said externally observable indication correspondingly relating to at least one of the following:

that said switch member is at said APP concurrent with said switch member being at said APP;

that said switch member is at said AEP concurrent with said switch member being at said AEP;

that said switch member is at said APP concurrent with said switch member being at said APP; and that said switch member is at said AEP concurrent with said switch member being at said AEP.

7. The safety device according to claim 1, including one of the following:

wherein said switch member from said APP to said AEP in linear motion along an activation axis, and wherein said rod member is linearly deployable from said retracted position, in which the rod member is enclosed in a housing and thereby not externally observable, and a deployed position, in which the rod member projects outside of said housing and is thereby externally observable;

wherein said switch member from said APP to said AEP in pivoting motion about a pivot axis, and wherein said rod member is pivotably deployable from said retracted position, in which the rod member is enclosed in a housing and thereby not externally observable, and a deployed position, in which the rod member pivots to a position outside of said housing and is thereby externally observable;

wherein said switch member from said APP to said AEP in linear motion along an activation axis, and wherein said rod member is linearly deployable from said retracted position, in which the rod member is enclosed in a housing and thereby not externally observable, and a deployed position, in which the rod member projects outside of said housing and is thereby externally observable; or wherein said switch member from said APP to said AEP in pivoting motion about a pivot axis, and wherein said rod member is pivotably deployable from said retracted position, in which the rod member is enclosed in a housing and thereby not externally observable, and a deployed position, in which the rod member pivots to a position outside of said housing and is thereby externally observable.

8. The safety device according to claim 6, wherein said retracted position corresponds to said AEP, or wherein said retracted position corresponds to said APP.

9. The safety device according to claim 6, including one of the following:

wherein said marker element comprises an electromagnetic wave transmitter configured for selectively operating in a transmitting mode or in a non-transmitting mode, wherein in said transmitting mode said electromagnetic wave transmitter selectively transmits electromagnetic waves within a first wavelength range, and wherein in said non-transmitting mode said electromagnetic wave transmitter does not transmit electromagnetic waves within said first wavelength range; or wherein said marker element comprises an electromagnetic wave transmitter configured for selectively operating in a first transmitting mode or in a second transmitting mode, wherein in said first transmitting mode said electromagnetic wave transmitter selectively transmits electromagnetic waves within a first wavelength range, and wherein in said second transmitting mode said electromagnetic wave transmitter transmits electromagnetic waves within a second first wavelength range different from said first wavelength range.

10. The safety device according to claim 1, wherein said actuation mechanism is configured for selectively moving said switch member from said APP to said AEP, responsive to an actuation event.

11. The safety device according to claim 10, including one or more of the following:

wherein said safety device is coupled to a communication module, and wherein said actuation event includes the communication module receiving an externally transmitted first attack signal;

wherein said safety device is coupled to a timing module, and wherein said actuation event includes the timing module determining that a predetermined time period has elapsed from a start time;

wherein said safety device is coupled to an altitude sensor module, and wherein said actuation event includes the altitude sensor module determining that a predetermined altitude has been reached; or wherein said safety device is coupled to a navigation module, and wherein said actuation event includes the navigation module determining that a predetermined geographical position has been reached.

12. The safety device according to claim 1, including one of:

wherein the safety device is operatively connected to a Remove Before Operation (RBO) pin having an engaged configuration wherein the RBO pin mechanically prevents arming of the S&A device, and a disengaged configuration wherein the RBO pin cannot mechanically prevent arming of the S&A device; or wherein the safety device is operatively connected to a Remove Before Operation (RBO) pin having an engaged configuration wherein the RBO pin mechanically prevents arming of the S&A device and concurrently mechanically prevents movement of said switch member from said APP to said AEP, and a disengaged configuration wherein the RBO pin cannot mechanically prevent arming of the S&A device, and cannot mechanically prevent movement of said switch member from said APP to said AEP.

13. The safety device according to claim 1, further comprising a positional sensor system including at least one emitter sensor set configured for sensing at least one said position of the switch member, each said emitter sensor set comprising an emitter and a sensor aligned therewith along a first axis, wherein movement of the switch member between the APP and AEP either allows or blocks sensing by the sensor of emissions emitted by the emitter.

14. A munition, comprising:

a munition explosive;

a safe and arm (S&A) device for activation of munition explosive;

the safety device of claim 1.

15. The munition according to claim 14, wherein the S&A device comprises a detonator spaced from an output lead by a barrier member having a barrier portion and a transfer lead portion.

16. A safety device for use with a munition, the munition including a munition explosive and a safe and arm (S&A) device for activation of the munition explosive, the safety device comprising:

a switch member, configured for mounting the S&A device thereto, said switch member being movable between at least two switch positions while carrying the S&A device therewith, said at least two switch positions including:

a first switch position, being an arming prevention position (APP), in which arming communication between the munition explosive and the S&A device is prevented; and a second switch position, being an arming enabling position (AEP), in which arming communication between the munition explosive and the S&A device is allowed; and an actuation mechanism for selectively moving said switch member at least from said APP to said AEP to thereby enable the S&A device, when armed, to detonate the munition explosive via the switch member;

marker element, wherein the marker element is configured for providing an externally observable indication corresponding to the switch member being in at least one of said switch positions; and wherein said marker element comprises a rod member that is deployable from a retracted position, in which the rod member is not externally observable, and a deployed position, in which the rod member is externally observable;

a lock mechanism for reversibly or irreversibly locking the switch member at said AEP after the switch member has moved from the APP.

17. A munition, comprising:

a munition explosive;

a safe and arm (S&A) device for activation of munition explosive;

a safety mechanism comprising:

a switch member, configured for mounting the S&A device thereto, said switch member being movable with the S&A device between at least two positions including:

an arming prevention position (APP), in which arming communication between the munition explosive and the S&A device is prevented; and an arming enabling position (AEP), in which arming communication between the munition explosive and the S&A device is allowed;

said switch member comprising a marker element, wherein the marker element is configured for providing an externally observable indication corresponding to the switch member being in at least one of said switch positions; and wherein said marker element comprises a rod member that is deployable from a retracted position, in which the rod member is not externally observable, and a deployed position, in which the rod member is externally observable;

a lock mechanism for reversibly or irreversibly locking the switch member at said AEP after the switch member has moved from the APP;

an actuation mechanism for selectively moving said switch member at least from said APP to said AEP to thereby enable the S&A device, when armed, to detonate the munition explosive.

18. A vehicle, configured for motion, and comprising the munition of claim 14.

19. A method for operating a munition, the method comprising:

deploying the munition, the munition of claim 14;

selectively moving said switch member from said APP to said AEP;

arming the S&A device;

causing the S&A device to detonate the munition explosive via the switch member.

20. The vehicle according to claim 18, comprising a fuselage, wherein in the retracted position the rod member does not project outside the fuselage, while in the deployed position the rod member projects outside of the fuselage.

* * * * *